US006162151A

United States Patent [19]

Tani et al.

[11] Patent Number: 6,162,151

[45] Date of Patent: Dec. 19, 2000

[54] AMBULATORY EXERCISE MACHINE AND AMBULATORY EXERCISE SYSTEM

[75] Inventors: Tomoyuki Tani; Akihiko Sakai; Shizuko Hattori, all of Ibaraki-ken; Atsushi Koseki, Toride; Tsutomu Fujimoto; Seizi Iizuka, both of Tochigi-ken; Takao Nagata, Utsunomiya; Tohru Horie, Tochigi-ken, all of Japan

[73] Assignee: Hitachi, Ltd., Tokyo, Japan

[21] Appl. No.: 08/940,010

[22] Filed: Sep. 29, 1997

[30] Foreign Application Priority Data

Sep. 30, 1996 [JP] Japan ..... 8-258232
Mar. 5, 1997 [JP] Japan ..... 9-050019

[51] Int. Cl.[7] ..... A63B 22/00

[52] U.S. Cl. ..... 482/54; 482/69

[58] Field of Search ..... 482/51, 54, 52, 482/66, 68, 69–74; 434/247, 255

[56] References Cited

U.S. PATENT DOCUMENTS 5,662,560 9/1997 Svendsen et al. ..... 482/69
5,704,881 1/1998 Dudley ..... 482/69
5,788,606 8/1998 Rich ..... 482/69

*Primary Examiner*—Glenn E. Richman
*Attorney, Agent, or Firm*—Antonelli, Terry, Stout & Kraus, LLP

[57] ABSTRACT

An ambulatory exercise machine which can easily carry out suitable ambulatory exercise in accordance with a condition of a trainee. A walking path surface is provided for the trainee and a drive drives the walking path surface. An assist arrangement is provided which includes support arms supporting the waist part of the trainee in front and at sides of the trainee and which enables a space between left and right arms to be adjusted. The assist arrangement includes a drive which drives the support arms. Further, the support arms enable attachment of a belt for holding the trainee so that the trainee is movable within a desired range.

19 Claims, 14 Drawing Sheets

AMBULATORY EXERCISE MACHINE AND AMBULATORY EXERCISE SYSTEM

BACKGROUND OF WHICH THE INVENTION

The present invention relates to an ambulatory exercise machine and an ambulatory exercise system with which a person can experience false walking, and in particular to an ambulatory exercise machine or an ambulatory exercise system which enables the walking function of an old-aged person or a person whose walking function is wound by a disease, an accident or the like.

Related Art

These years, the number of bedridden persons increases more and more since the number of old-aged person who remarkably lose strength in their legs increases. Further, there are many persons whose walking functions are wound by diseases or accidents. It is very important for these persons to carry out recovery exercise for their walking functions.

Japanese Laid-Open Utility Model No.2-1131 discloses a training tool for walking, in which a trainee moves back and forth by walking while his hands grips two hand rails which are laid on his both sides in parallel with each other in order to perform ambulatory exercise. It is noted that this document discloses several parallel rods for assisting a trainee in walking, which are crossing one another, and parallel rods and a walking path which have concavities and convexities.

Further, Japanese Laid-Open Patent No. 8-141026 discloses a training device comprising a pair of left and right looped belts exhibiting as a waking path surface for a trainee, and gripping means for supporting the body of the trainee. The gripping means in this training device is extended through the arm's pits of the trainee so as to laterally and vertically hold the trainee, and further belts attached to the gripping means and adapted to be worn around the hip part and leg parts of the trainee vertically supports the trainee.

Japanese Laid-Open Patent No. 8-141027 discloses an ambulatory exercise device for a trainee who requires maintaining or recovering his walking function. This ambulatory exercise device comprises walking path means having a looped belt exhibiting a walking path surface for the trainee, means for controlling the running speed of the looped belt, means for setting a loading characteristic of the walking path means, means for detecting a running speed of the looped belt, and means for computing a control rule for the walking path means, from the loading characteristic and the walking speed.

This document discloses an equivalent mass, an equivalent damping coefficient or an equivalent spring constant as the loading characteristic of the walking path means, and a formula for computing a drive force of the walking means from the above-mentioned loading characteristic as the control rule, a resistance force owned by a drive mechanism for the walking path surface and a displacement of the looped belt. Further, it discloses a control device for controlling the drive force of the walking path means, that is, the walking path surface in accordance with the above-mentioned control rule.

Further, the document discloses that the above-mentioned device realize a passive ambulatory exercise machine with which a trainee can exercise in accordance with a force for kicking the walking path surface.

However, the ambulatory exercise using the parallel rods as mentioned above, cannot freely adjust or select a load burdened upon a trainee. That is, the trainee has to require to hold the parallel rods or to be assisted by an assistant in order to support his body without depending upon his leg power. In this case, it is impossible for the trainee to perform an exercise while he always and stably receives a suitable load or an assisting force, in accordance with a leg power, a physical strength, a physical condition, a degree of recovery or the like. Further, it is difficult for the trainee to freely perform ambulatory exercise using the upper part of his body in such a way that the trainee swings his arms, or twists his waist since the trainee has to hold the parallel rods.

Meanwhile, the training device disclosed in the Japanese Laid-Open Patent No. 8-141026, can control the looped belt and the gripping means so as to control a load burdened upon a trainee in order to cope with the above-mentioned problem caused by holding the parallel rod. However, it is not sufficiently contemplated to use this training device for ambulatory exercise in which the upper part of the body of the trainee is used. Further, the device disclosed in the above-mentioned Japanese Laid-Open Patent No. 8-141027 is not sufficiently contemplated for a trainee whose one of legs remarkably lower its strength in comparison with the other one and who performs ambulatory exercise. It is preferable to carry out such an exercise that his both legs are used, independent from each other, only one of legs being trained in one training cycle, without both legs being trained in one training cycle in such a case that the trainee has a relatively large difference between his both leg strengths of the trainee, or he is seriously wound in his leg function. In this case, the above-mentioned conventional technology possibly offers such a problem that the two left and right belts which are provided for both legs of the trainee are driven in accordance with a detected force which is applied unconsciously thereto by the trainee.

SUMMARY OF THE INVENTION

A first object of the present invention is to provide an ambulatory exercise machine which can easily perform suitable ambulatory exercise in accordance with a physical condition of a trainee.

A second object of the present invention is to provide an ambulatory exercise machine having such a feature that a training mode paying attention to only one both legs of a trainee can be selected among a plurality of training modes.

A third object of the present invention is to provide an ambulatory exercise system which can instruct a trainee in ambulatory exercise from a remote position.

In order to achieve the above-mentioned first object, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and at sides of the latter, and enabling the space between left and right arms to be adjusted, and drive means for driving the support arms, the support arms being able to attach a belt for holding the trainee so that the trainee is movable within a desired range.

Further, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and at sides of the latter and enabling the space between left and right arms to be adjusted, and drive means for driving the support arms, the support arms having a longitudinal depth of 155 mm and being able to attach a belt to the rear end part thereof.

Further, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and at sides of the latter and enabling the space between left and right arms to be adjusted, and drive means for driving the support arms, the support arms including left and right arms having a thickness of less than 40 mm, and being able to attach a belt for holding the trainee so that the trainee is movable in a desired range.

Further, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and rear of the latter and enabling the space between left and right arms to be adjusted, and drive means for driving the support arms, the support arms being adapted to be driven in a vertical range of 600 to 1,200 mm measured from the walking path surface, and in a longitudinal range of ±110 mm, and being able to attach a belt for holding the trainee so that the trainee is movable in a desired range.

Further, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and at sides of the latter and enabling the space between left and right arms to be adjusted, the support arms incorporating a position adjusting switch so that the drive device of the support arms falls in a position adjusting control mode only when this switch is turned on, but the turn-on of this switch is not effective during ambulatory exercise, and the support arms being able to attach a belt for holding the trainee so that the trainee movable in a desired range.

Further, there is provided an ambulatory exercise machine including walking path surface means, assist means provided in front of the path surface means, for assisting a trainee standing on the walking path surface means, and synthetic control means for controlling the walking path surface means and the assist means, in which the walking path surface means further comprises a walking path surface for the trainee, and drive means for driving the walking path surface, and the assist means comprises support arms supporting the waist part of the trainee in front and at sides of the latter and enabling the space between left and right arms to be adjusted, and drive means for driving the support arms, the synthetic control means is connected to data processing means, and is adapted to receive data relating to exercise for the trainee from the data processing means in order to control the drive means for the support arms and the walking path surface, the support arms being able to attach a belt for holding the trainee so that the trainee to be movable in a desired range.

Further, there is provided an ambulatory exercise machine including walking path surface means and assist means provided in front of the walking path surface means, for assisting a trainee standing on the walking path surface means, in which the walking path surface means further comprises a walking path surface for the trainee, and drive means for driving the walking path surface, and the assist means comprises support arms supporting the waist part of the trainee in front and at sides of the latter and enabling the space between left and right arms to be adjusted, the support arm being able to attach a belt for holding the trainee so that the trainee is movable in a desired range, and the walking path surface means and the assist means being separatably fixed together.

Further, there is provided an ambulatory exercise machine including walking path surface means and assist means provided in front of the walking path surface means, for assisting a trainee standing on the walking path surface means, in which the walking path surface means further comprises a looped belt serving as a walking path surface for the trainee, and drive means for driving the looped belt, and the assist means comprises support arms supporting the waist part of the trainee in front and at sides of the latter and enabling the space between left and right arms to be adjusted, the looped belt being driven in one of a mode in which the looped belt is driven at a constant speed and a mode in which the looped belt is driven in accordance with a walking speed of the trainee while the constant speed is limited to 3 km/h at the maximum.

Further, there is provided an ambulatory exercise machine including walking path surface means and assist means provided in front of the walking path surface means, for assisting a trainee standing on the walking path surface means, in which the assist means comprises support arms supporting the waist part of the trainee in front and at sides of the latter and enabling the space between left and right arms to be adjusted, and drive means for driving the support arms, and the walking path surface means further comprises a looped belt serving as a walking path surface for the trainee, drive means for driving the looped belt, and detecting means for detecting the trainee approaching the front end part or rear end part of the looped belt, the drive means for the looped belt incorporating a first stop mode for stopping the looped belt or a second stop mode for stopping the looped belt for a time which is longer than that in the first stop mode, and the looped belt being stopped in the second mode when the detecting means detect the trainee.

Further, there is provided an ambulatory exercise machine including walking path surface means and assist means provided in front of the walking path surface means, for assisting a trainee standing on the walking path surface means, in which the assist means comprises support arms supporting the waist part of the trainee in front and at sides of the latter and enabling the space between left and right arms to be adjusted, drive means for driving the support arms, and detecting means for detecting the trainee, and the walking path surface means further comprises a looped belt serving as a walking path surface for the trainee, and drive means for driving the looped belt, the drive means for the looped belt incorporating a first stop mode for stopping the looped belt or a second stop mode for stopping the looped bell for a time which is longer than that in the first stop mode, and the looped belt being stopped in the second mode when the detecting means does not detect the trainee.

Further, in order to achieve the second object of the present invention, according to the present invention, there is provided an ambulatory exercise machine comprising walking path surface means having two left and right walking surfaces, and control means for controlling running of the walking path surfaces, independent from each other, in which the control means incorporates means for continuously controlling one of the walking path surfaces at one constant position.

Further, there is provided an ambulatory exercise machine comprising walking path surface means having two left and right walking surfaces, and control means for controlling running of the walking path surfaces, independent from each other, in which the control means incorporates means for fixing one of the walking path surfaces, respectively to the left and the right walking path surfaces, independent from each other.

Further, there is provided an ambulatory exercise machine comprising walking path surface means having two left and right walking surfaces, and control means for controlling running of the walking path surfaces, independent from each other, in which the control means incorporates means for holding one of the walking path surfaces while controlling only the other one of the walking path surfaces so as to run.

In this arrangement, the means for holding one of the walking path surfaces at a constant position, may be means for controlling the walking path surface means at a constant position, or means for mechanically fixing the walking path surface. Further, the mechanical fixing means is controlled by control means. In a simplest example, this control means controls to switch the mechanical fixing means between two conditions, that is, a fixed condition and an unfixed condition.

Further, there is provided an ambulatory exercise machine comprising walking path surface means having two left and right walking surfaces, and control means for controlling running of the walking path surfaces, independent from each other, in which the control means incorporates first control means detecting a condition of the walking path surfaces, for controlling the walking path surfaces, independent from each other, a second control means for fixing one of the walking path surfaces while for controlling the other one of the walking path surfaces, and means for selecting one of the first and second control means.

Further, there is provided an ambulatory exercise machine comprising walking path surface means having two left and right walking surfaces, and control means for controlling running of the walking path surfaces, independent from each other, in which the control means incorporates a plurality of control modes, and means for selecting one of the plurality of the control modes, for the left and right walking surfaces, independent from each other.

According to the arrangements for achieving the second object, the person can exercise, putting one of his both legs on a walking path surface which is stationary or which is regarded to be stationary, while putting the other one of his both legs on a walking path surface which is in a possible running range or which is running.

With this arrangement, the walking path surface for the other one of the legs, can be driven at a constant speed, and more over, can be controlled so that the speed of the walking path surface or the reaction force the trainee is subjected to from the walking path surface, vary.

In order to achieve the third object, there is provided an ambulatory exercise system including an ambulatory exercise machine comprising walking path surface means and assist means provided in front of the walking path surface means, for assisting a trainees standing on the walking path surface means, incorporating (1) means for extracting biological data from a trainee on exercise, (2) first image pick-up means for picking up an image from the trainee, (3) first display means for representing data to the trainee, (4) second image pick-up means located, distant from the ambulatory exercise machine, (5) second display means located, distant from the ambulatory exercise machine, (6) means for transmitting the biological data to a person at the second display means side, (7) means for transmitting from the second image pick-up means to the first display means, and transmitting from the first image pick-up means to the second display means, (8) means for intercommunicating between the trainee and the person at the second display means, (9) instructor side manipulating means for allowing an instructor to manipulate the ambulatory exercise machine, and (10) interrupting means for preferentially displaying data from the first image pick-up means, on the second display means.

According to the present invention, the support arms holds the waist part of a trainee and the space between the left and right arms of the support arms can be adjusted so that the trainee can easily swing his arms or the like so as to enhance the freedom of the upper part of the his body, and can perform a suitable ambulatory exercise.

Further, one of the left and right walking path surfaces can be held at a constant position, accordingly, an exercise mode in which optimum exercise can be made paying attention to one of the trainee legs.

Further, the transmitting means for transmitting data between a trainee and an instructor at a position distant from the trainee is provided so as to preferentially display data transmitted from the instructor, on the display means on the trainee side, thereby it is possible to provide a remote-controlled ambulatory exercise system with a high degree of reliability.

DESCRIPTION OF THE PREFERRED EMBODIMENTS

Explanation will be detailed hereinbelow of embodiments of the present invention with reference to the drawings.

Figure 1:
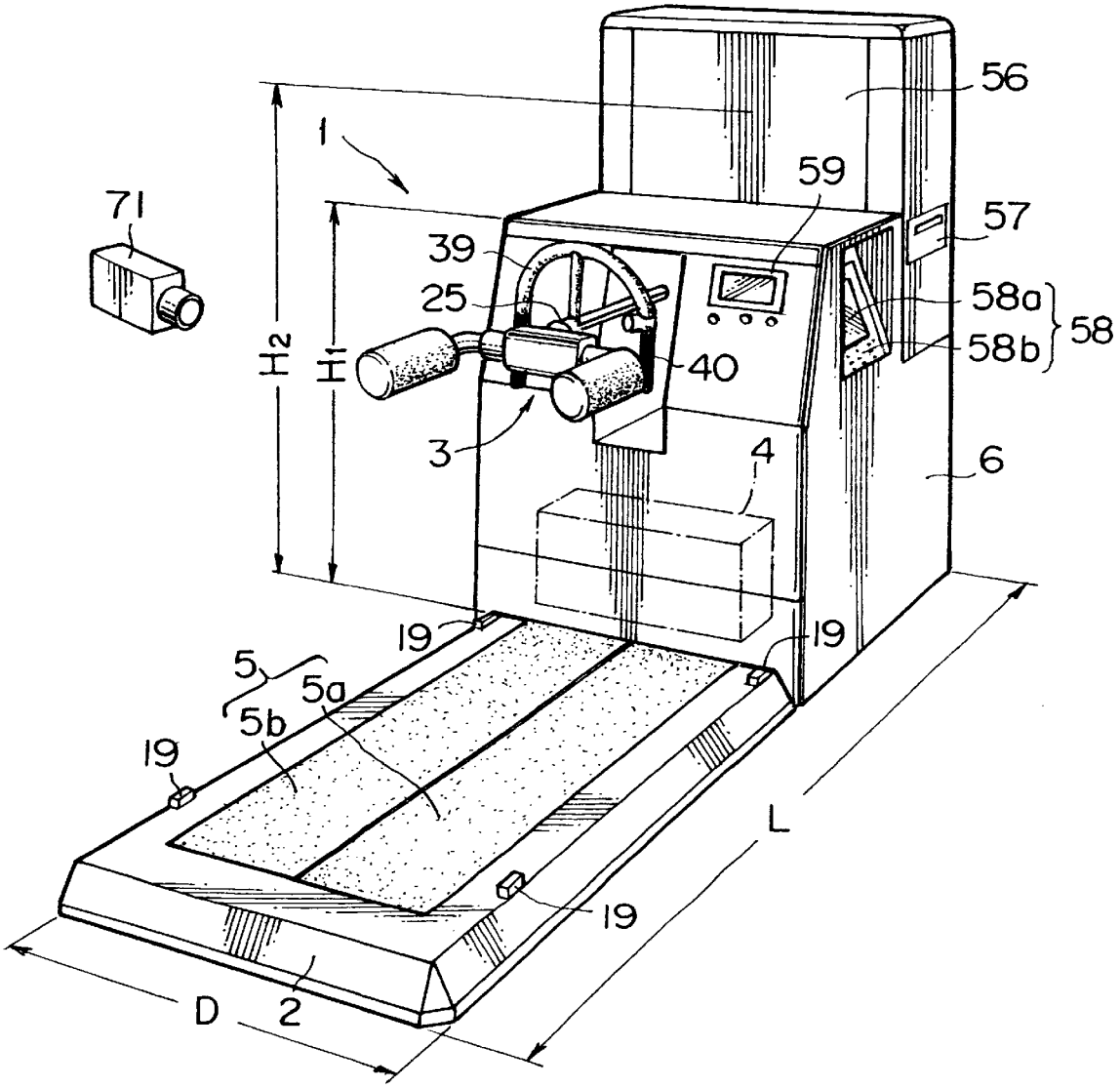
FIG. 1 is a perspective view illustrating an arrangement in an embodiment an ambulatory exercise machine according to the present invention.

FIG. 1 is a view which shows an ambulatory exercise machine 1 as a whole. The ambulatory exercise machine 1 is composed of a walking path surface device 2, an assist device (support device) 3, an image display device 56 and a synthetic control device 4 for controlling the former devices.

The synthetic control device 4 is located in a chamber defined by panels 6 of the assist device 3, and electrically connected to the above-mentioned devices. It is noted that an instructor 3 instructs a trainee U on ambulatory exercise.

The walking path surface device 2 exhibits an endless rotatable walking path surface, that is, it comprises a looped belt 5. The trainee U can perform exercise for walking and the like, on this walking path surface without displacement. The looped belt 5 is preferably composed of two left and right belts (for left and right legs 5*a*, 5*b*) which are moved in association with motion of the left and right legs. However, this is not exclusive, that is, the looped belt may be composed of a single one.

The assist device 3 is arranged in front of the walking path surface device 2, being separatable from the walking path surface device 2, for holding the trainee U so as to reduce the load burdened upon the trainee, and to correct the posture of the same. In this arrangement, reducing the load is in general called as decreased load of a body weight or decreased load, and is adapted to reduce the body weight to be held by the trainee U by a vertical force effected in a vertical direction. Conventionally, this has been carried out in such a way that the trainee U is lifted upward, or the trainee performs exercise in water. Meanwhile the correction of the posture is made by acting a pulling force upon the trainee in order to allow the main body of the trainee U to be in a vertical posture when his posture inclines.

Further, in this embodiment, a step part is formed on the rear surface side of the assist device 3, and the image display device 56 is set on the step part. The image display device 56 is provided so as to be separatable from the panel 6 of the assist device 3. With this arrangement, the height of the device can be decreased, and the weight thereof can be reduced in order to facilitate the transportation thereof. Further, an image source can be fed from an image reproducing device 57. A selecting switch is provided as selecting means for selecting one of two modes, that is, a mode in which the display of images can be made by reproduction of the images reproducing device 57 or a mode in which images are externally inputted. An example of the external input communication is data or image transmitted from a scientific therapist at a remote place, which well be detailed later. The image reproducing device 57 uses a laser disc with which the trainee can carry out exercise while he enjoys images reproduced therefrom. In this case, it is possible to select whether the reproducing speed is made to be proportional to a walking speed or not.

Further, in this embodiment, a video camera as means 71 for picking up an image from the trainee, is provided at a position where an image of the entire body of the trainee U can be picked up from his one side.

As to dimensions of the ambulatory exercise machine, it is preferable that the length L is less than 3,500 mm, and the width D is less than 1,000 mm in view of such a fact that parallel rods for conventional ambulatory exercise have an overall length of about 3,500 mm and an overall width D of about 1,000 mm. In this embodiment, the length L is 3,108 mm and the width D is 930 mm (the walking path surface part has a width of 900 mm in order to make the machine more compact. Further, a height Hi from the looped belt 5 to the top surface of the panel 6 is set to be less than 1,050 mm, and a height H2 up to the center part of the image display device 56 is set to be less than 1,300 mm. It is noted that these heights are lower than the height of the eyes of the trainee in his standing posture. Since an old-aged person or a handicapped person at the initial stage of exercise has, in general, a lower viewpoint, and accordingly, the trainee even having a lower view point can carry out exercise while watching images or the like.

Explanation will be made of the arrangements of the above-mentioned devices.

Figure 2A:
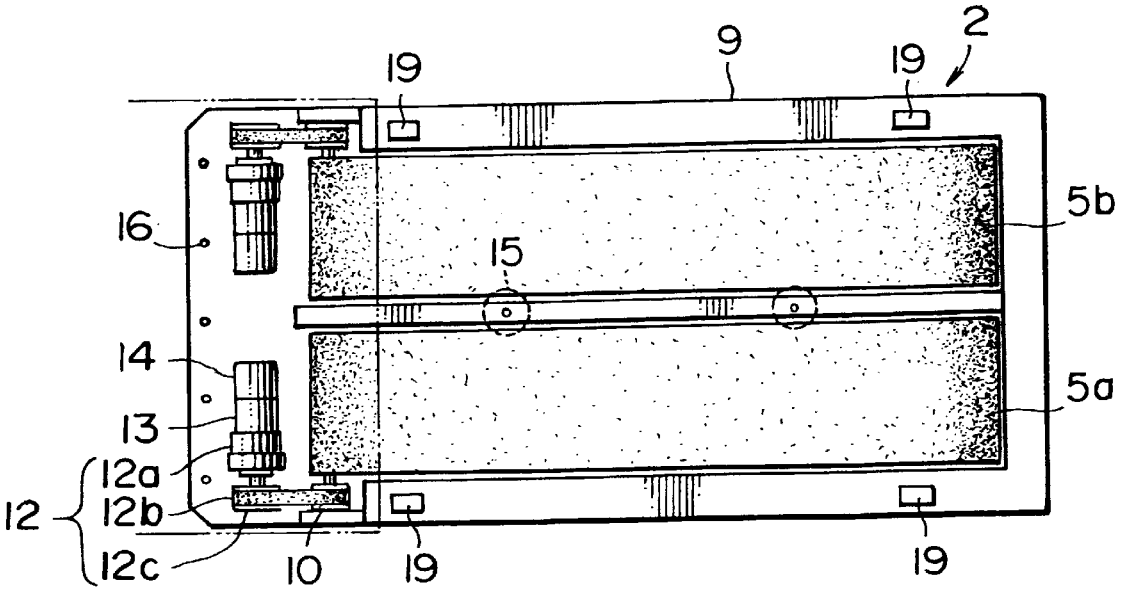
FIG. 2A to FIG. 2B are top and side views illustrating a walking path surface means according to the present invention.
Figure 2B:
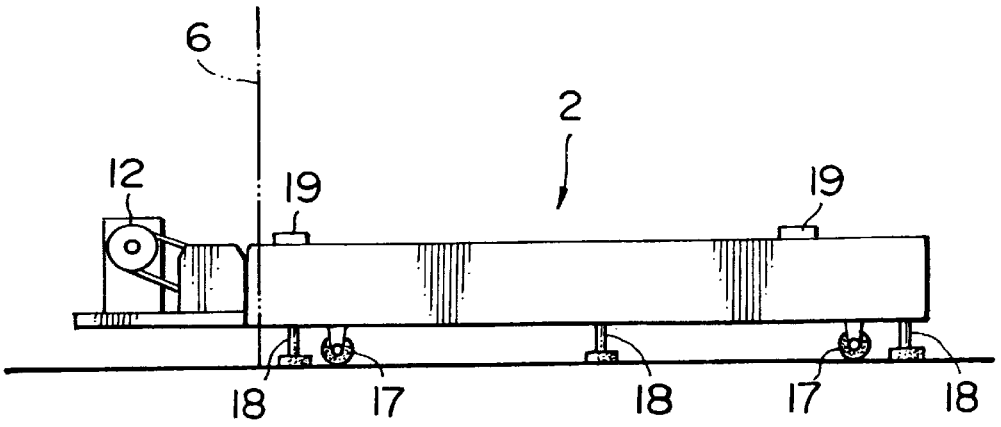
Figure 3:
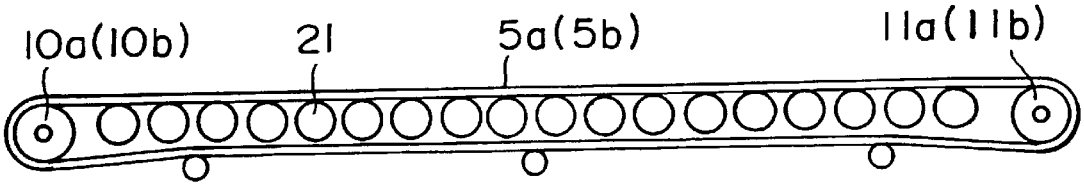
FIG. 3 is a sectional side view illustrating the walking path surface means according to the present invention.

FIGS. 2*a* to 2*b* are views which show the walking path surface device 2, that is, FIG. 2A is a view showing the walking path surface device 2 from the walking path surface side, and FIG. 2B is a view showing the same from the left side thereof. Further, FIG. 3 shows the arrangement of the looped belt 5 and belt support means (mechanism).

The walking path surface device 2 is separatable from the assist device 3, and is electrically connected, through a cable, to a control device 4 surrounded by the panels 6, together with the assist device 3. Further, the looped belt 5 is composed of two looped belts 5*a*, 5*b* respectively for the left and right legs of the trainee, drive means for respectively driving the left and right looped belts 5*a*, 5*b*, and means for supporting the looped belt 5, fixing members for fixing the drive means and the belt supporting means to a frame 9.

The drive means comprises drive rollers 10 (10*a* and 10*b*), driven rollers 11 (11*a* and 11*b*) and rotary mechanism 12 (12*a*, 12*a* and 12*c*). The driven rollers 11 can be positionally adjusted in the longitudinal direction of the looped belt 5, and accordingly, the looped belts wound around the drive rollers 10 and the driven rollers 11, are stretched under suitable tension. The rotary mechanisms for driving the drive rollers 12 have the same structures with respect to each other, and are independent from each other, that is, for example, each being composed of a motor through the intermediary of a belt 12*b* and a pulley 12*c*, thereby it is possible to rotate the looped belt 5. Further, the rotary mechanism 12 comprises speed detecting means 13 for detecting a speed of the looped belt 5 in association with the rotation thereof, and brake means 14 composed, for example, of a motor brake, for securing and holding the looped belt 5. Each of the drive rollers 10 and the driven rollers 10 preferably has a barrel-like shape, having a crown, in order to prevent the looped belt 5 from meandering. Pulleys 15 having vertical rotary shafts may be suitably arranged along the longitudinal direction of the looped belt 5 so as to restrain the looped belt from meandering.

A frame 9 for the walking path surface device 2 is formed therein with connecting holes 16, and is provided with wheels 17, horizontally adjusting devices (legs with horizontal adjusters) 18 and walking range detecting sensors 19. The walking path surface device 2 and the assist device 3 can be separated from each other, and the proximal end part 28 of the assist device 3 are connected and fastened to the connecting holes 16 in the frame 18 by means of screws and the like. The connecting cable electrically connecting the walking path surface device 2 with the assist device is also disconnectable by means of connectors. It is noted that the rotary mechanism and the like are surrounded by the panels 6 of the assist device 3, as indicated by the chain line in FIG. 2.

The horizontally adjusting devices 18 are composed of, for example, leveling bolts which are lifted up while the wheels 17 are set on the floor surface when the walking path surface device 2 is displaced. On the contrary, when the walking path surface device 2 is fixed, the horizontally adjusting devices 18 are lowered so as to be set on the floor surface while the wheels 17 are lifted up. Accordingly, the frame 9 becomes unmovable even though the trainee U swings his body left and right, and back and forth. Since the floor surface is, in general, uneven, it is preferable to set a level on the top surface of the frame 19 or to embed the same therein, with which the walking path surface device 2 can be set to be horizontal by means of the horizontally adjusting devices 18.

By the walking range detecting sensors 19 which are attached to the walking path surface device 2 at four positions at the front and rear ends of the same, whether the trainee U walks in a normal walking range or not can be determined. When one of the walking range detecting sensors 19 detects the trainee, it is determined that the posture of the trainee is abnormal, and accordingly, the walking path surface device 2 is moderately decelerated and is then stopped by a deceleration time in a range of 0.3 to 0.8 sec., under an instruction from the synthetic control device 4, and the looped belt 5 is fixed and held by the braking means 14. It is noted that the walking range detecting sensors 19 are associated with exercise starting and completing switches 67, 68 which will be detailed later, and are energized during a period from the time when the starting switch 67 is depressed to the time when the completing switch 68 is depressed, or until a set time period for exercise is completed. That is, the walking range detecting sensors 19 are energized only during ambulatory exercise, but are not energized when the trainee is introduced, the ambulatory exercise machine is positionally adjusted and so forth.

The belt support means is composed of several passively rotatable free rollers 21 which are arrayed so as to extend their rotary shafts in a direction crossing the longitudinal direction of the belt, and the looped belt 5 is supported by these free rollers 21. With this arrangement, the resisting force (mainly caused by its friction) of the looped belt 5 can be reduced.

In this arrangement, sensors which can detect recession or bending deformation of the free rollers may be provided in order to detect such a condition that the foots of the trainee lands. If these sensors are provided for some free rollers 21 along the longitudinal direction of the looped belt 5, the positions of the landing legs can also be detected.

Figure 4:
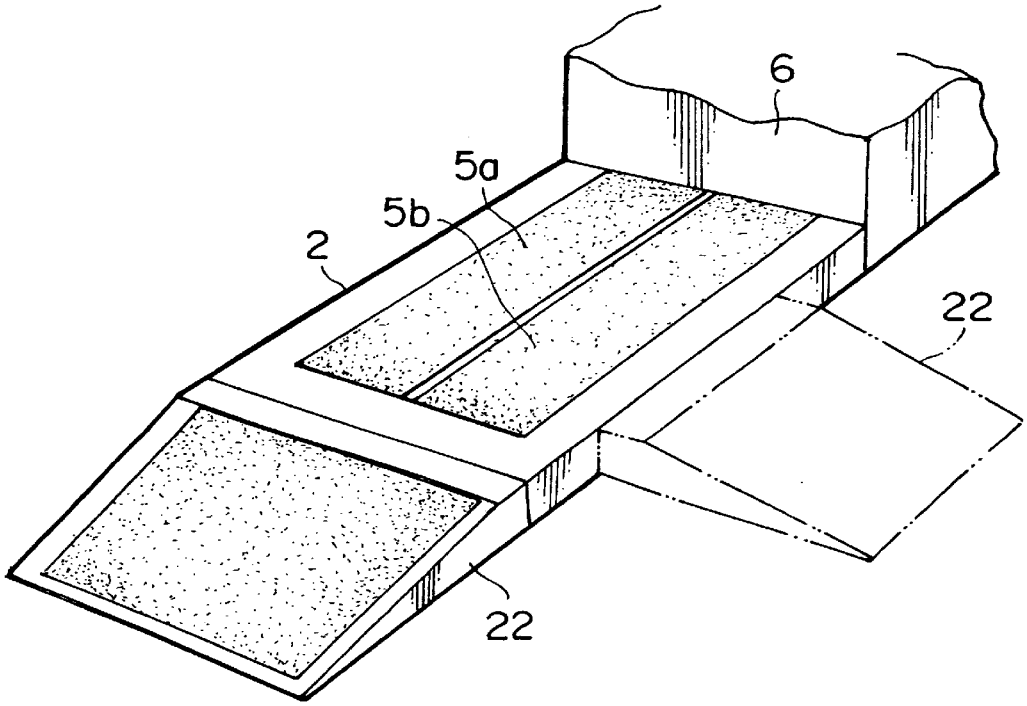
FIG. 4 is a schematic perspective view illustrating an embodiment of a slop according to the present invention.

The walking path surface device 2 incorporates a slope 22 as shown in FIG. 4, which is set in accordance with a floor space. This slope 22 is used for eliminating a bump when the trainee rides onto the walking path surface device 2, having a height at its one end, which is substantially equal to that of the walking path surface device 2. Further, it has a slope angle which is less than 7 deg. in order to allow the trainee to ride onto the walking path surface device 2 with the use of a wheel chair with no help of an instructor. The slope is removably incorporated to the walking path surface device 2, and is preferably connected to the rear part of the walking path surface device 2, but may be connected to the left or right side part of the same. In the case of connection to the rear part of the walking path surface device 2, a realtive lage space should be ensured in a walking direction. However, in the case of connection to the right or left side part thereof, not so large space is required in the walking direction.

The walking path surface device 2 has two control modes, that is, a load walking mode wherein the looped belt U is moved by receiving a force with which the trainee U walks, kicking rearward, and a constant speed walking mode wherein the looped belt 5 is moved at a set constant speed. One of these control modes can be selected by the instructor S in accordance with a physical condition of the trainee U.

Figure 5:
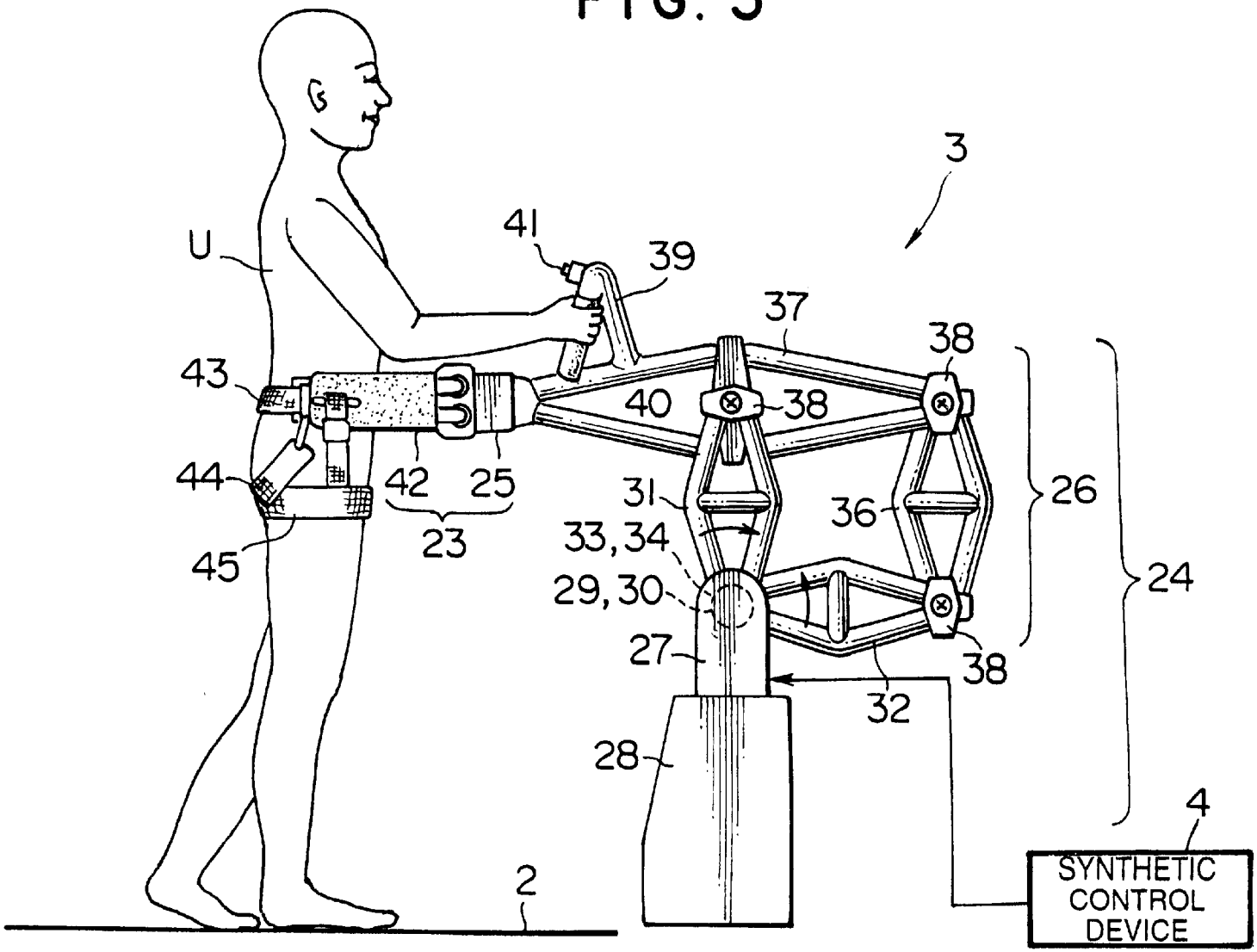
FIG. 5 is a view illustrating an arrangement of an assist device.

FIG. 5 is a view which shows the overall arrangement of the assist device. The assist device 3 is composed of gripping means 23 for holding the body of the trainee U, drive means 24 for changing the posture of the gripping means 23, a force sensor 25 for detecting a force which is applied to the gripping means 23 by the trainee U, and the synthetic control device 4 for controlling these means. With this arrangement, a force is exerted to the trainee U through the intermediary of the gripping means 23 in order to carry out "reduction in load" and "correction of posture".

The drive means 24 is composed of a link mechanism 26, a rotary mechanism 27 and a base part 28 which serves as a stationary support part of the assist device 3. The rotary mechanism 27 for operating the link mechanism 26 is provided in the upper part of the base part 28. The rotary mechanism 27 is composed of left and right rotary shafts 29, 30 which are rotated, independent from each other. The left and right rotary shafts 29, 30 are connected to one end of drive links 31, 32 in the link mechanism 26, and are rotated by motors through the intermediary of belts. That is, the drive link 31 is horizontally moved through the rotation of the right rotary shaft 29, as indicated by the arrow, and the drive link 32 is vertically moved through the rotation of the left rotary shaft 30 as indicated by the arrow. It is noted that the rotary mechanism 27 incorporates left and right angular sensors 33 and angular sensors 34 for measuring rotating angles and angular speeds, and braking means for braking the rotary mechanism 27, which is not shown.

The drive links 31, 32 in the link mechanism 27 are connected at their the other end to a short follower link 36 and a long follower link 37 through rotatable knots 28, respectively, and the short follower link 36 is connected at the other end with the long follower link 37 through a rotatable knots 38. With this mechanism, the long follower link 37 is operated in an arrow-like plane (a plane defined by a direction in which the trainee U advances and a vertical direction), following the motions of the two drive links 31, 32.

The force sensor 25 is attached to the front end part of the long follower link 37, and has a function for measuring a force in the arrow-like plane, that is, it measures a force acting between the trainee U and the assist device 3 through the gripping means 23.

A handle 39 is attached to the long follower link 37 in the vicinity of the front end of the latter. In such a case that the upper part of the body of the trainee U largely swings, left and right, and back and force, the trainee grips the handle 29 while he carries out ambulatory exercise, the upper part of the body can be restrained from swinging. By walking while restraining the body of the trainee from swinging, static walking can be made while extremely restraining the displacement of the gravitational center during walking. Such walking is suitable for a trainee who just initiates a function recovery exercise. If the swinging of the upper body can be reduced, such exercise that the trainee walks, rhythmically swinging his left and right arms without gripping the handle 39, is preferably carried out. This is called as dynamic walking which can be usually made by a normal healthy person.

Further, since the handle 39 is attached to such a position that the force sensor 25 cannot detect a force which is exerted to the handle 39 by the trainee U, even though the trainee U catches the handle 39 when he is to fall down, the force exerted to the trainee U does not abruptly vary, thereby it is possible to allow the trainee U to catch the handle 39 by himself, so as to prevent the trainee from falling down without the trainee U being unstable. The handle 39 may has such a shape that its one end is fixed to the long follower link 37, and is horizontal at its free end as that of the parallel rods, or may be semicircular. The handle 39 incorporates a grips 40 gripped by the trainee U and a stop switch 41 with which the trainee can stop the ambulatory exercise machine 1 by himself, and which is set in the center part of the handle 39. Accordingly, it is possible to prevent erroneous operation and to use the machine for an incomplete paralyzed person or the like.

The gripping means 23 for holding the body of the trainee U is attached to the force sensor 25 on the side remote from the long follower link 37. The gripping means 23 is adapted to hold the front and the sides of the waist part of the trainee. There are provided a support arm 42 having a cushion, a belt 43 for holding the rear of the waist part so as to prevent the trainee from falling down, various belt harnesses including a belt 44 for holding the bottom of the hip so as to prevent the trainee from sinking, and a belt 44 for holding the body of the trainee at the waist part and the thigh part of the latter. These belt harnesses are used in any of several configurations in accordance with a function recovery condition of the trainee U.

For example, in order to correct the posture, the body holding belt 45 is not always required, and only the support arm 42 and the rearward falling down preventing belt 43 may be used. The support arm 42 holds the front and left and right sides of the waist part of the trainee, and the rearward fall-down preventing belt 43 connected to the support arm 42 supports the rear part of the waist part. The waist part of the trainee is surrounded by the support arm 42 and the rearward fall-down preventing belt 43, and accordingly, it is possible to prevent the trainee from falling down, except falling down in a vertical direction.

Further, the sink preventing belt 44 may be used in accordance with a purpose of the trainee. The sink preventing belt 44 connected to the support arms 42 has a length which is adjusted so that it extends along the bottom of the hip part of the trainee U. Accordingly, in such a case that the trainee is likely to fall rearward, and so forth, the thigh part can be held by the belt 44, thereby it is effective for safety measures.

In order to reduce the load, the support arm 42 and the body holding belt 45 are used. The body holding belt 45 in the arrangement shown in FIG. 5 holds the trainee U at his waist part and the hip part. In this case, the rearward fall-down preventing belt 43 is not always necessary, but may be used in combination. Accordingly, the trainee can easily balance his body, and it is possible to prevent occurrence of such a case that body is excessively apart from the support arm 42 so as to cause the force sensor 25 and a trainee detecting sensor 49 which will be detailed later, to be difficult to detect a condition of the trainee.

Figure 6:
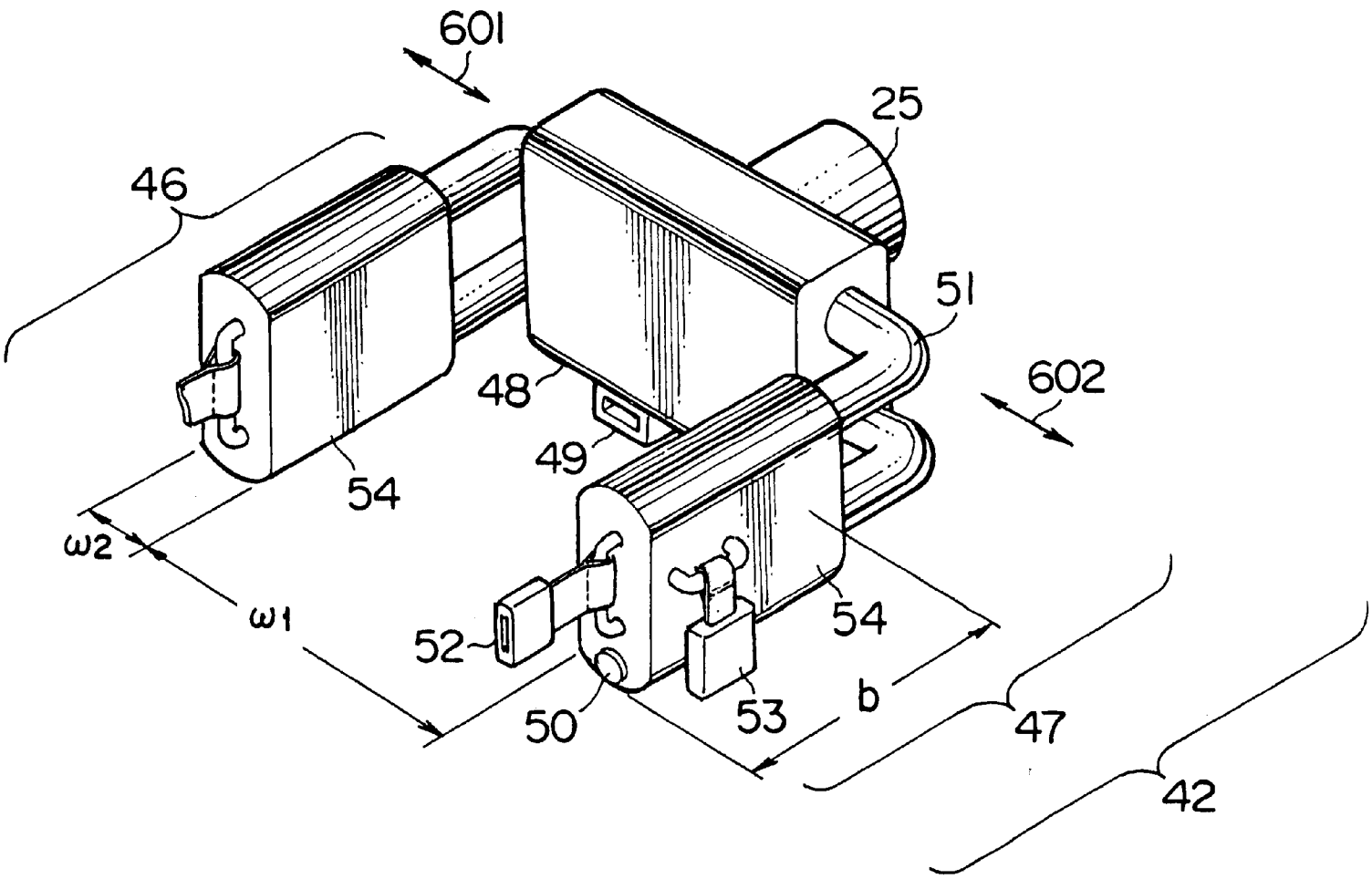
FIG. 6 is a schematic perspective view illustrating an embodiment of support arms according to the present invention.

The support arm 42 which is one of basic elements constituting the gripping means 23 will be explained with reference to FIG. 6. It is noted that rectangular flat cushions are used in this embodiment, but the shape of the cushions should not be limited to this rectangular shape, but it may be cylindrical. That is, it may be selected to the trainee's liking. The support arm 42 attached to the force sensor 25 is composed of left and right gripping parts 46, 47, and an adjusting mechanism 48 for adjusting the space width between the gripping parts 46, 47 to the shape of the body of the trainee U. Further, the support arm 42 incorporates a trainee detecting sensor 49 and a position adjusting switch 50.

The left and right gripping parts 46, 47 are laterally symmetric, and have an L-like shape, support members 51 being supported at one end thereof to the adjusting mechanism 48 and attached at the other end thereto with connecting ports 52 for connecting the rearward fall-down preventing belt 43 and the sink preventing belt 44, and connecting ports 53 for connecting the body holding belt 45. Further, the support members 51 are covered thereover with cushion members 54. The width w2 of the left and right gripping parts 46, 47 is set to be less than 40 mm, that is, less than the clearance between the waist part and the arms which is naturally hung down. In this case, flat cushions as shown in FIG. 6 may be effectively used.

In the adjusting mechanism 48, the support members 51 are supported by means of bearings or the like, and are slid in the directions of arrows 601, 602 so as to be retractable with respect to the adjusting mechanism 48. Further, there are provided stopper mechanisms which are not shown for fixing the support members 51 after the gripping parts 46, 47 are adjusted so as to have a desired space width, and a cushion member with which the outer periphery of the adjusting mechanism 48 is covered. The space width w1 between the left and right gripping arms 46, 47 can be calculated from a minimum value which is calculated from a formula: averaged value (274 mm)−2×standard deviation (17 mm) for the side width of the ilium, and a maximum value which is calculated from a formula: averaged value (318 mm)×2×standard deviation (14 mm) for the width of the hip, (refer to the statistic data source for body shapes, a marginal width for giving the trainee a freedom for motion around the waist part, and a thickness of a garment (which is estimated to be 25 mm), and can be adjusted in range from 300 to 400 mm. Naturally, although the adjusting range is set to be greater than the above-mentioned range, it is desirable that the adjusting range should be set up to 400 mm in order to firmly hold the support members 51 so that the support arms 51 can be held within the adjusting mechanism by a degree as large as possible.

The support arm 42 is small-sized in order to allow the instructor S to easily manipulate the support arms 42, and accordingly the gripping parts 46, 47 have a length (depth) b which is less than 155 mm. With this arrangement, an instructor can allow the trainee who has a minimum value which is obtained by a formula: Averaged Value (188 mm)×2×Standard Deviation (18 mm) for the thicknesswise diameter of the abdomen to make close contact with the support arm 42 in rear of the trainee U by means of the rearward falling preventing belt 43. Accordingly, a condition such as a degree of longitudinal inclination of the trainee is always satisfactorily detected by the force sensor through the support arms, thereby it is possible to carry out suitable assistance to the trainee with the use of the assist device.

The above-mentioned side width of the ilium and the width of the hip part should be referred to, for example, "Measuring Human Body for obtaining Design Data", written by Koharam Uchida, and Hatta, first edition 1986 Japan Publishing Service, in which avaraged values, and standard deviations of the above-mentioned values of men and women are shown.

The trainee detecting sensor 49 is a reflective type optical sensor for detecting the presence of the trainee. It is determined that the trainee U falls down when it cannot detect the trainee during exercise, and accordingly, the walking path surface device 2 moderately decelerates in a decelerating time in a range from 0.3 to 0.8 sec., and then comes to a stop. Thereafter, the looped belt 5 is fixed and held by the brake means 14. When the assist device 3 is to be displaced to a retracted position having been previously set, if the presence of the trainee is detected, this displacement is not carried out, thereby, the protecting function can be exhibited. In this arrangement, the rearward fall-down preventing belt 43 prevents the trainee U from being shifted away from the sensor 49, thereby it is possible to prevent erroneous detection.

The position adjusting switch 50 is used for setting the support arm 42 to the waist position of the trainee U, and as far as the depression of the position adjusting switch 50 continues, the synthetic control device 4 is shifted into a position adjusting mode so as to carry out control with which a force instruction value is set to zero. Accordingly, the support arm can be operated under light force so that the support arm 42 can be easily set to the position of the waist of the trainee. It is noted that during exercise, the position adjusting switch 50 is ineffective.

The assist device 3 is suitable for a trainee having a height of 130 to 180 cm, and the range in which the reference position of the assist device 30 is set is determined in consideration with such a fact that the support arms 42 support the trainee at the position of his waist in view of the physical features of the trainee. A necessary movable range is obtained by adding a degree of swinging of the trainee to the above-mentioned range. Specifically, a vertical range is 630 to 1,180 mm while a longitudinal range is ±110 mm. It would be sufficient if these movable ranges cover a height of 1,200 mm in an upward direction and a height of 630 mm in a downward direction. A movable limiting range (which will be hereinbelow referred as "soft limit") is set to include therewithin the above-mentioned range. By setting such ranges, the link mechanism 26 can have a compact size, and further, the assist device and the entire ambulatory exercise machine both can have compact sizes. Further, there are provided, outside of the movable limit range, a limiting range (hard limit) for electrically stopping the drive with the use of limit switches 78, and a limiting range (mechanical stoppers 79) as a mechanical limiting range. Since the assist device 3 is controlled so as to be operated in response to a force which is exerted to the device by the user T (the trainee U or the instructor S), control is made such that a force for returning the assist device within the soft limit is produced if it exceeds the soft limit. During positional adjustment, if it exceeds the reference value set range of the assist device 3 during exercise, a force for returning it within the range is similarly produced.

Further, when abnormality occurs during exercise so that the walking path surface device 2 comes to an abrupt stop, a shock proportional to a walking speed would be exerted to the trainee U. There are provided, for protecting the trainee U, an abnormal stopping mode in which the assist device 3 and the walking path surface device 2 are both rapidly stopped, and an emergency stopping mode in which only the assist device 3 is rapidly stopped but the walking path surface device 2 is moderately decelerated and is finally stopped. These modes are effective in accordance with a kind of abnormality. That is, the emergency stopping mode in which the walking path surface device 2 moderately comes to a stop, is effected when the walking range detecting sensor 19, the trainee detecting sensor 49, the trainee stopping switch 41 detects the trainee, or an emergency stopping switch 55 which will be described later, detects the instructor.

It is noted that wheels and horizontally adjusting devices are provided to the panels 6 for the assist device 3, similar to the walking path surface device 2, that is, the assist device 3 has such a structure that it can be moved and be stationary.

The above-mentioned assist device 3 is adapted to support the waist part of the trainee. However, in the case of a trainee who has enhanced his leg strength, safety devices such as hand rails gripped by the trainee may be provided, on opposite sides of and in front of the walking path surface device 2, instead of the above-mentioned assist device 3.

Figure 7:
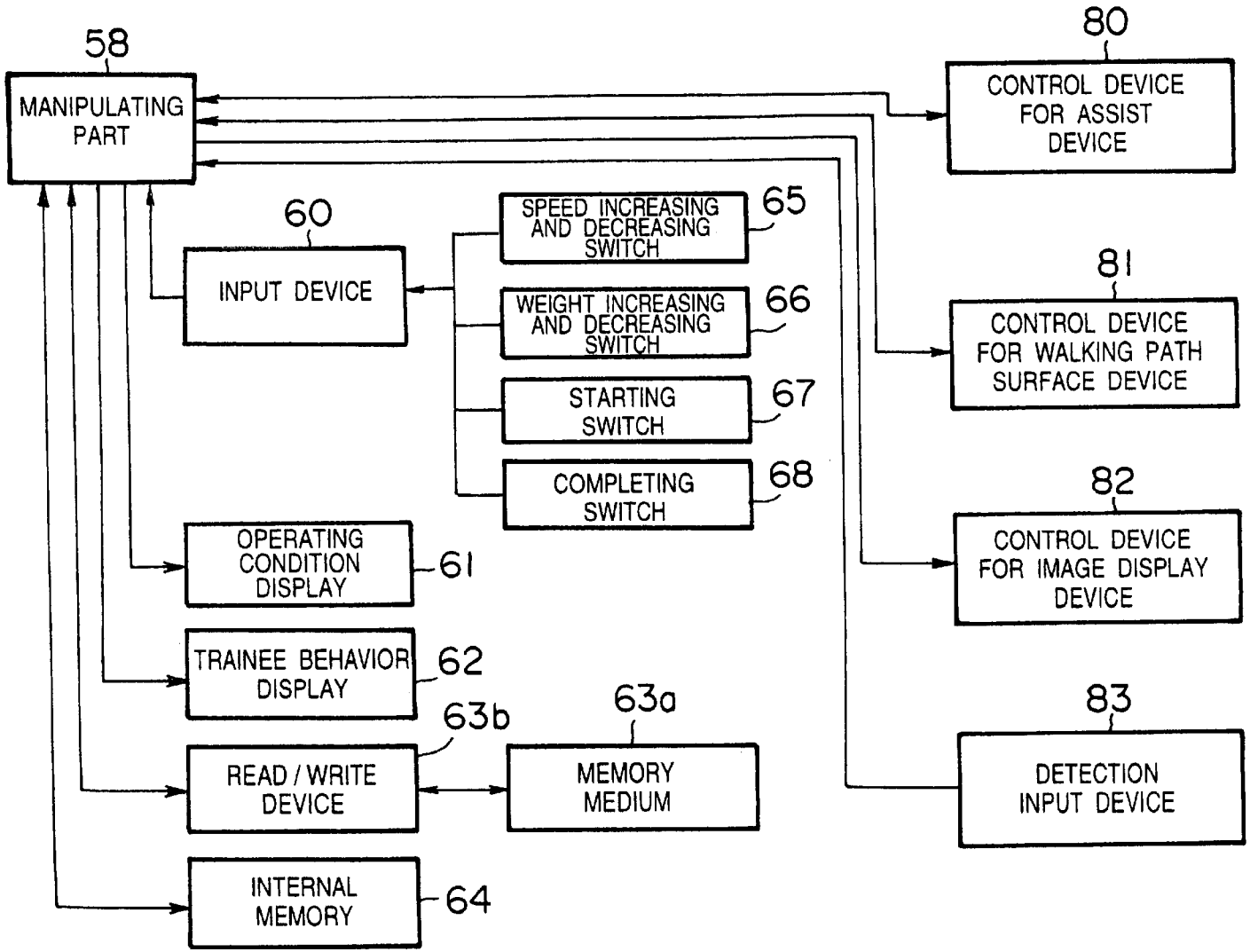
FIG. 7 is a view illustrating an arrangement of a synthetic control device according to the present invention.

Explanation will be made of the arrangement of the synthetic control device with reference to FIG. 7.

The synthetic control device 4 is composed of components 80, 81, 82, 83 for controlling the assist device 3, the walking path surface device 2 and an image display device 56, a manipulating part 58, a display unit 59 and the like.

The manipulation of the walking path surface device 1 is carried out by the manipulating part 58 which is attached to one side of one of the panels 6, being inclined with respect to the vertical direction in order to reduce affection of stray light or the like and to facilitate the manipulation. The manipulating part 58 is composed of an input device 60, an operating condition display 61 for displaying an operating condition of the walking path surface device 2, a rainee behavior display 62 for displaying a behavior of the trainee U during exercise, which can be measured by means of the detecting means for the walking path surface device 2, a removable or replaceable memory medium 63*a* for storing therein set motions of the devices in the walking path surface device 2, and a behavior of the trainee U during exercise, a read/write device 63*b* for reading and writing data from and into the memory medium 63*a*, and an internal memory 64 serving as a memory device inherent to the manipulating part 58. For example, it is a small-sized computer incorporating a disc drive for reading and writing data to and from a 3.5 inch displaceable flexible disc medium. This medium should not limited to a specific form, and any one of various kinds of mediums including an IC card and a card having a magnetic recording part may be used. The input device 60 in the manipulating part 58 incorporates a speed increasing and decreasing switch 65 for inputting conditions for exercise or the like, a weight increasing switch 6E, a starting switch 67 for instructing exercise, a completing switch 68 and the like.

These years, in various kinds of facilities such as hospitals, cards each having a magnetic recording part are distributed among the users such as patients, having a such a trend that data concerning the users, that is, data to be recorded on medical sheets, or the like are managed with the use of the card or identification codes recorded on the card.

Accordingly, it is convenient to manage various data concerning the ambulatory exercise together with other data (such as data to be recorded on medical sheets). In this case, the walking path surface device and/or the synthetic control device therefor are connected to the main computer, and accordingly, it is effective to extract data as to the exercise through the card.

The display unit 59 is attached to the one of the panels 6 in front of the trainee U. The content of the operating condition display 61 or the trainee behavior display 62 is displayed on the display unit 59. For example, even a remaining time for the exercise or a walking speed is effective for the trainee U. It is noted that a display similar to that on the display unit 59 may be displayed so as to be used instead for the display unit 59. In this case, data may be displayed being overlapped with one corner of the image display device 56.

Figure 8:
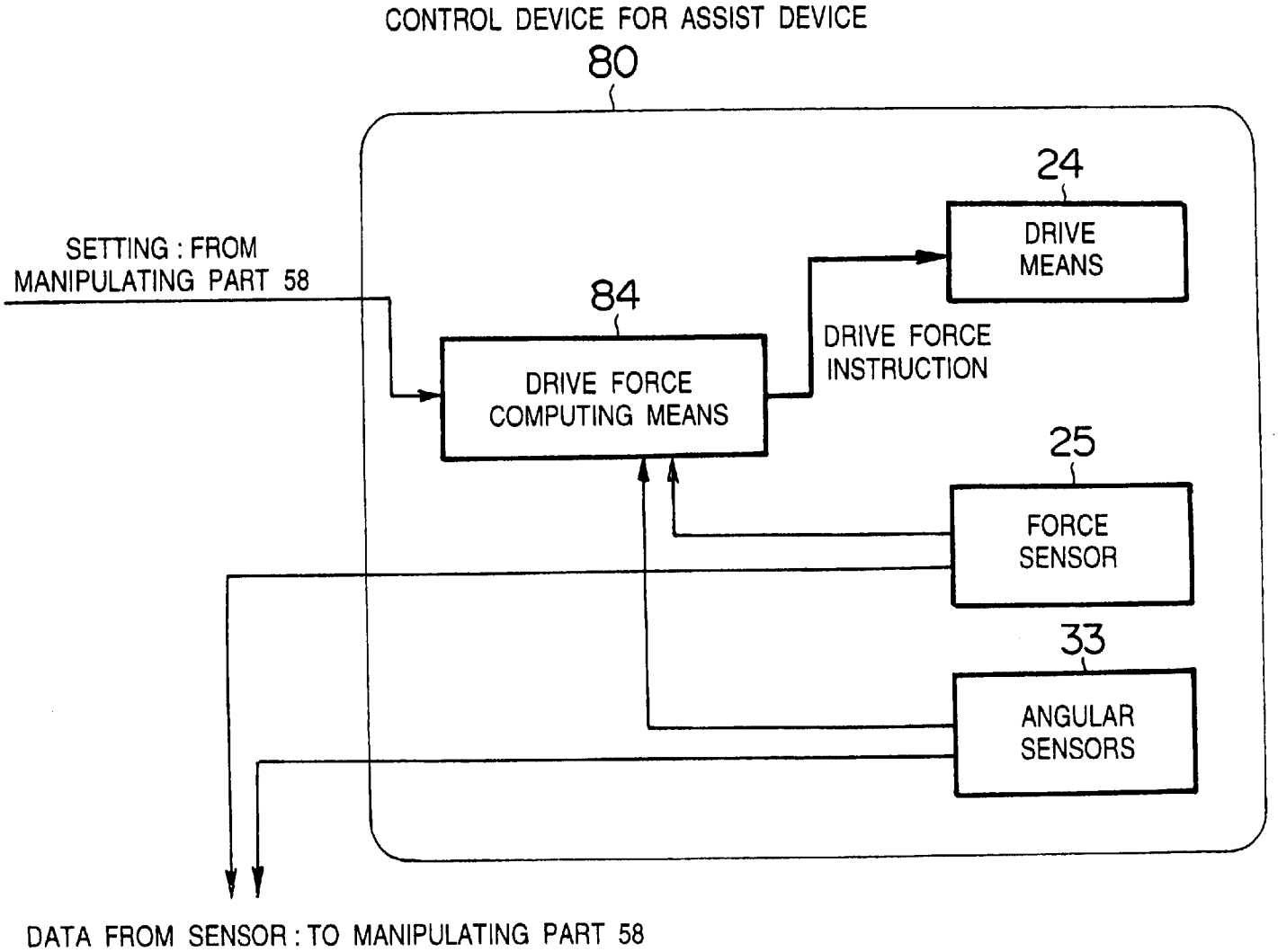
FIG. 8 is a view illustrating an arrangement of a device for controlling the assist device according to the present invention.

The arrangement of a control device 80 for the assist device is shown in FIG. 8. This device synthesizes assist control for controlling the assist device 3 during exercise, and control exhibiting a force instruction value =zero during positional adjustment (zero force control) in accordance with settings inputted to the manipulating part 58.

The assist control controls a force exerted to the trainee U through the intermediary of the gripping means 23, which will be detailed latter. Further, the zero force control controls a force which exerted by the assist device 3 through the intermediary of the gripping means 23, to zero. Accordingly, when an external force is exerted to the assist device 3 through the intermediary of the gripping means 23, the gripping means moves in a direction in which the force is exerted, at a speed proportional to a degree of the force exerted thereto. This control is effective when, for example, the instructor S adjusts the position of the gripping mans 23. Even in either case, a drive force computing means 84 computes a force to be given by the drive means 24 from a force which is delivered from the force sensor 25 and which is exerted to the gripping means 23, a desired force value, and data from the angular sensor 33 so as to carry out either of the above-mentioned cases.

Data from the force sensor 25 and the angular sensor 33 in the assist device 3 are transferred to the manipulating part 58. Data from the force sensor 25 indicates a force by which the trainee U is assisted by the assist device 3, and data from the angular sensor 33 exhibit an aim for estimating a motion of the body (mainly the upper part of the body) of the trainee U.

Figure 9:
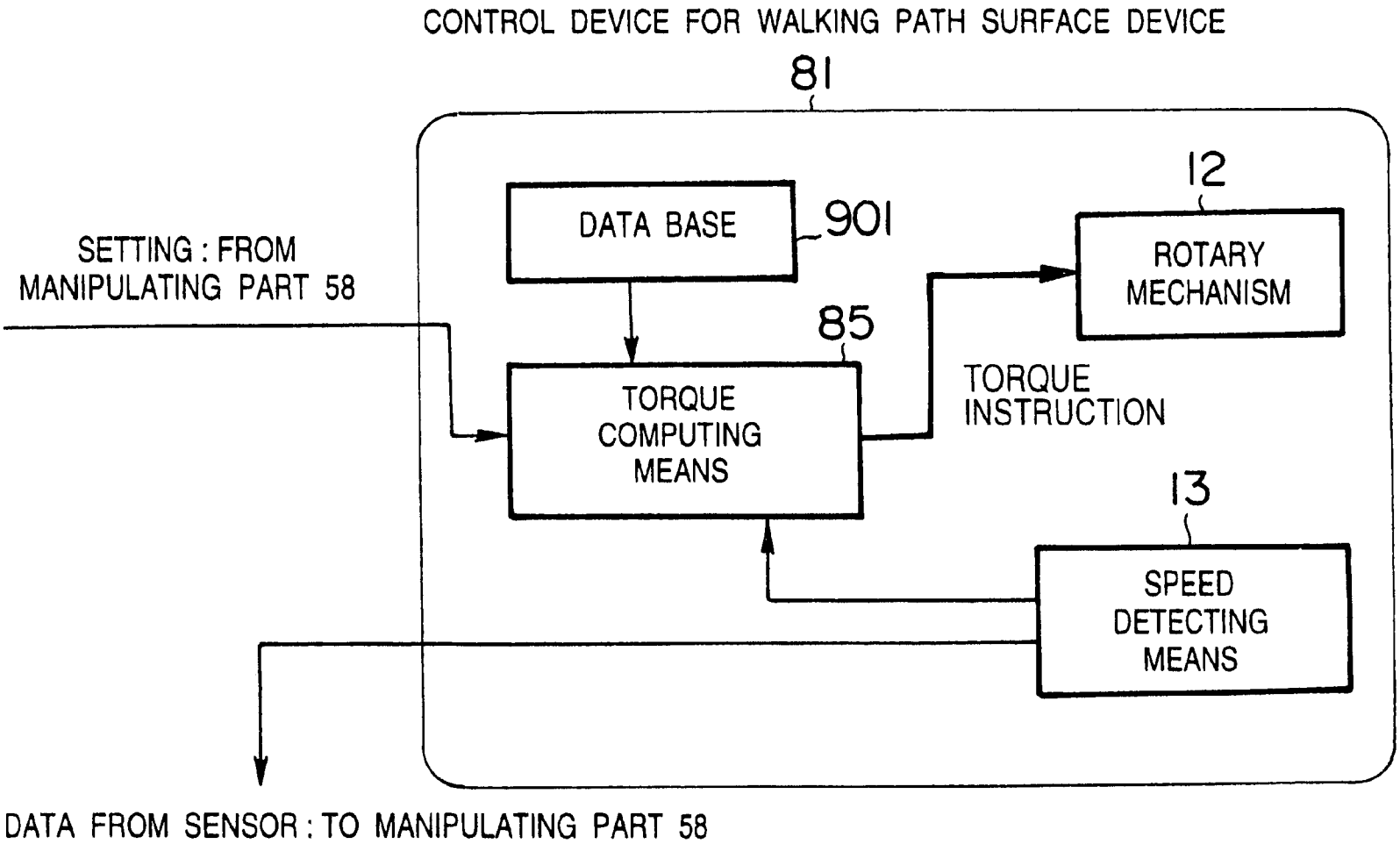
FIG. 9 is a view illustrating an example of the arrangement of a device for controlling the walking path surface device according to the present invention.

The arrangement of a control device 81 for the walking path surface device is shown in FIG. 9. This device synthesizes control of load walking and control of constant speed walking in accordance with settings inputted through the manipulating part 58. The control of load walking will be detailed later. During constant speed walking, the operation is made such that the speed of the looped belt 5 becomes equal to a desired speed inputted through the manipulating part 58. Even in either of the cases, a torque computing means 85 computes a force to be produced by the rotary mechanism 12 from data delivered from the speed detecting means 13, and carries out the control. In this embodiment, data used for the control, is fed from the manipulating part. However, exclusive data base 90 may be incorporated in the control device 81 for the walking path surface device.

Further, data from the speed detecting device 13 in the walking path surface device 2 is transferred to the manipulating part 58. Data from the speed detecting means 13 corresponds to a walking speed of the trainee U.

The control device 82 for the image display device, synthesizes control for image reproduction in association with the walking speed, and control in remote exercise, which will be detailed hereinbelow in accordance with settings inputted to the manipulating part.

Figure 10:
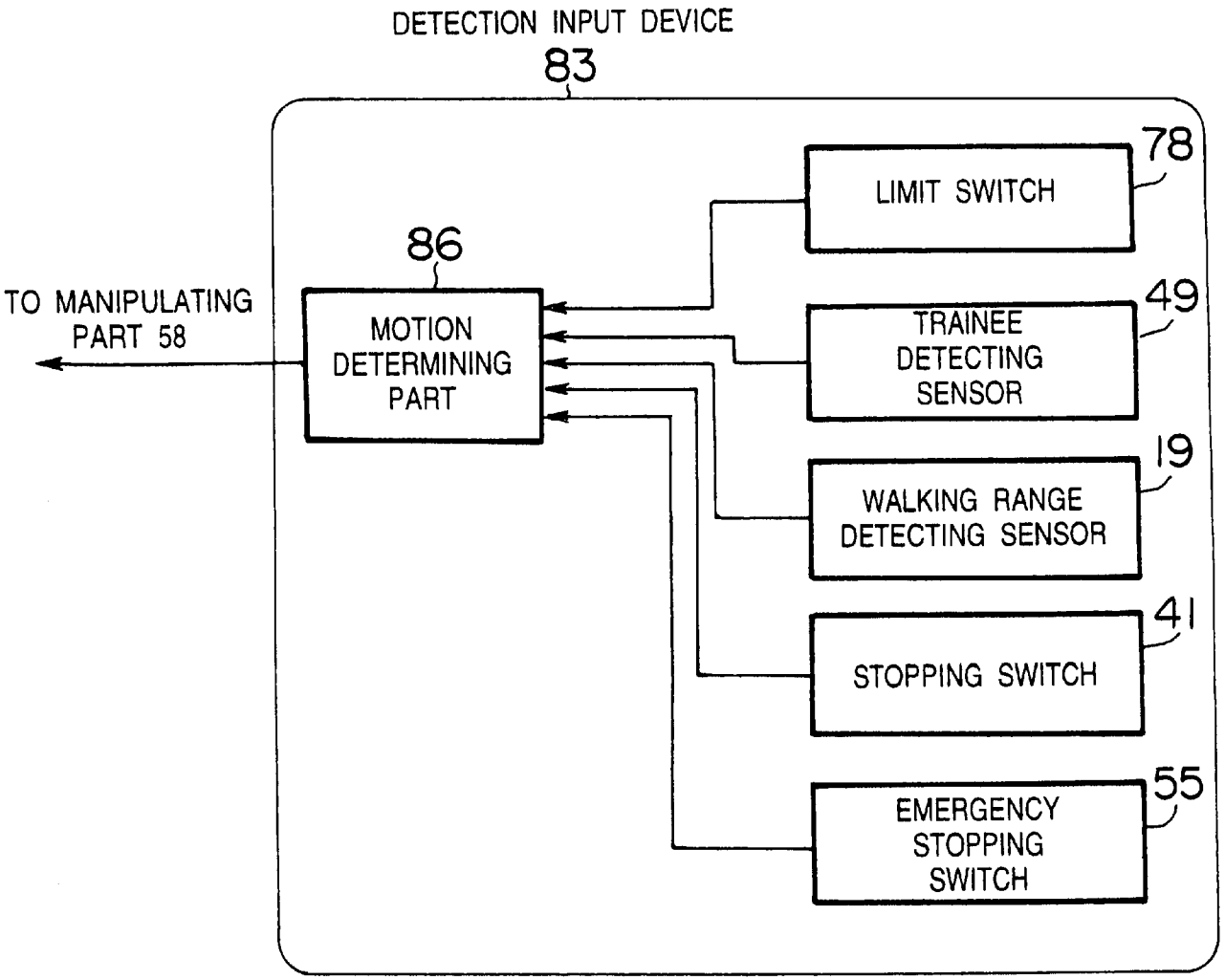
FIG. 10 is a view illustrating an example of the arrangement of a detecting and inputting device.

The arrangement of a detection input device 83 is shown in FIG. 10. This device receives signals from sensors and switches incorporated in the walking path surface device 2 and the assist device 3, which indicate an emergency condition, so as to determine a change in the operating condition. When a signal is inputted into the detection input device during operation of the ambulatory exercise machine 1, a motion determining part 86 delivers instructions for stopping the walking path surface device 2 and the assist device 3, to the manipulating part 58 in order to ensure a safety for the trainee U. and signals to be inputted are transmitted from the limit switch 78, the trainee detecting sensor 49, the walking range detecting sensor 19, the stopping switch 41 and the emergency stopping switch 55.

Next, explanation will be made of a method of using the ambulatory exercise machine 1.

A purpose of the assist device 3 is to exert a suitable force to the trainee U so as to reduce the load or to correct the posture of the trainee, and either one of the operating modes is selected by the instructor S in accordance with a physical condition of the trainee U or a purpose of exercise.

Since the movable range of the assist device 3 is within the sagittal plane, the assist force is the resultant of a force in a vertical direction and a force in an advancing (longitudinal) direction. Accordingly, the assist forces in the vertical direction and the advancing direction are expressed by a function of a displacement from the reference position which is at the front end of the assist device when the trainee stands upright during starting of the practice. It is noted that the continuity of the assist value with respect to the displacement is maintained.

(1.1) The correction of the posture

For example, in the advancing direction, estimating that the function of the assist force and the displacement is a straight line passing through the original point, a force proportional to the degree of the displacement in a direction reverse to that of the displacement is exerted to the trainee U, so that the trainee can feel that he is longitudinally pressed by a spring, and accordingly, the posture of the trainee is corrected The inclination can be set in accordance a degree of recovery of the muscular force of the trainee U, and in this embodiment, it is set to 5 kgf/cm. This means that compliance control is carried out in relation to the front end of the assist device 3. Further, an exercise range limit which is a threshold value with respect to the displacement is provided. When it is set so that the inclination is enhanced if it is greater than the threshold value (in this embodiment, it is set to 10 kgf/cm) the force exerted to the trainee U abruptly varies, and the trainee U feels that he apparently makes contact with a wall outside of the exercise range. The degree of the inclination corresponds to the resiliency of the wall. By changing the threshold value, the position of the imaginary wall can be arbitrarily set, and accordingly, if an allowable range for the posture of the trainee U is set, the prevention of fall-down of the trainee U can be materialized, and so forth, thereby it is possible to bee effective for safety measures. Further, similar setting is made in the longitudinal direction, the correction of the posture can be surely completed.

At this time, the gripping means 23 making contact with the trainee U can be sufficiently applied without using the body holding belt 45.

(1.2) Reduction of the load

A force is effected so that the trainee U is lifted up only in the vertical direction. However, if a constant force is exerted, independent from a displacement, when the trainee leans upon the assist device 3, he directly and continuously lowers together with the assist device 3. Accordingly, a threshold value is set for the downward displacement so that an upward force increases at an inclination (10 kgf/cm in this embodiment) when the displacement is less than the threshold value. Accordingly, the trainee is pushed back upward. Further, in the advancing direction the same setting as that of the correction of the posture is made, thereby it is possible to reduce the load while the posture of the trainee U is corrected.

It should be noted that the ratio between the load reducing force and the weight of the trainee (load reducing force/weight of the trainee) should not naturally be greater than 1. Further, if it becomes greater than a certain value, the body of the trainee U swings as a pendulum so as to be unstable. In this embodiment, it is set to ⅓ at maximum which is based upon the study relating to the body weight reducing load and the stability of the standing posture, made by Kozumi etc.

At this time, the gripping means 23 making contact with the trainee U surely support the trainee U with the absolute use of the body holding belt 45.

The motion of the walking path surface device 2 is set by selecting one of the constant walking mode in which the looped belt 5 is moved at a speed set by the manipulating part 58, and the load walking mode in which the trainee U can walk with his pace. Explanation will be made of the features of these mode.

(2.1) Constant speed walking mode

In order to allow an old-aged person, as the trainee U, to reasonably use the ambulatory exercise machine, the desired speed is finely set with a unit of 0.1 km/h, and accordingly, the maximum desired speed is set to 3.0 km/h which is smaller than an averaged walking speed (about 4.0 km/h) of ordinary healthy persons. This desired speed can be increased or decreased with pitches of 0.1 km/h by means of the speed increasing and decreasing switch 65, and accordingly, it is preferable that the instructor S changes this desired speed while he observes a condition of the trainee U.

(2.2) Load walking mode

Impedance control is applied to the control of the walking path surface device 2. One side looped belt is selected in one degree freedom model, and its equation of motion is given as follows:

$$M_a\ddot{X}+c_a\dot{X}+K_aX=f_u+f_f+F \tag{1}$$

Where

F: Force (external force) which is exerted by the trainee during a leg standing period;

$f_u$: Drive force of the walking path surface device;

$f_f$: Resistant force (such as a frictional force) of the mechanism of the walking path surface device;

X: Displacement of the looped belt;

$m_a$: Equivalent mass of the mechanism;

$c_a$: Equivalent damping coefficient of the mechanism;

$K_a$: Equivalent spring constant of the mechanism.

The trainee U to be exercised, is old-aged having a declined leg strength, and accordingly, although the mechanism has a reduced friction, an friction force offset for canceling out the resistant force $f_f$ is added. Further, only the viscous coefficient for the external force F of the walking path surface device 2 is changed from $c_a$ to $c_d$, so as to obtain the following equation:

$$M_a\ddot{X}+c_d\dot{X}+K_aX=F \tag{2}$$

and accordingly, the drive force $f_u$ is given by the following fomula:

$$F_u=(c_a-c_d)X-f_f \tag{3}$$

With the use of the above-mentioned formulae, the mechanism has a load characteristic exhibited by the formula (2). Further, an offset (weight) is again added to the drive force of a paralyzed leg (diseased leg) of an incomplete paralyzed trainee. Accordingly, the drive force of the diseased leg side becomes greater than the drive force of the nonparalyzed leg side (healthy side). Thus, a difference in drive force between the left and right legs of the trainee U can be compensated for.

Accordingly, the load characteristic of the walking path surface device 2 can be optionally set in accordance with strengths of the left and right legs of the trainee U. The trainee U can walk on the looped belt 5, variously changing the walking speed.

It is considered that the load characteristic of the walking path surface device 2 is not uniform during the leg standing period, and accordingly, a light load characteristic is set so as to allow the foot part to easily move rearward upon making contact with the floor while a heavy load characteristic is set so as to restrain the foot part from being excessively pulled rearward upon lifting from the floor. In particular, upon lifting from the floor, such a feeling that the upper part of the body is inclined forward is given so as to enhance the actual feeling of walking.

Figure 11:
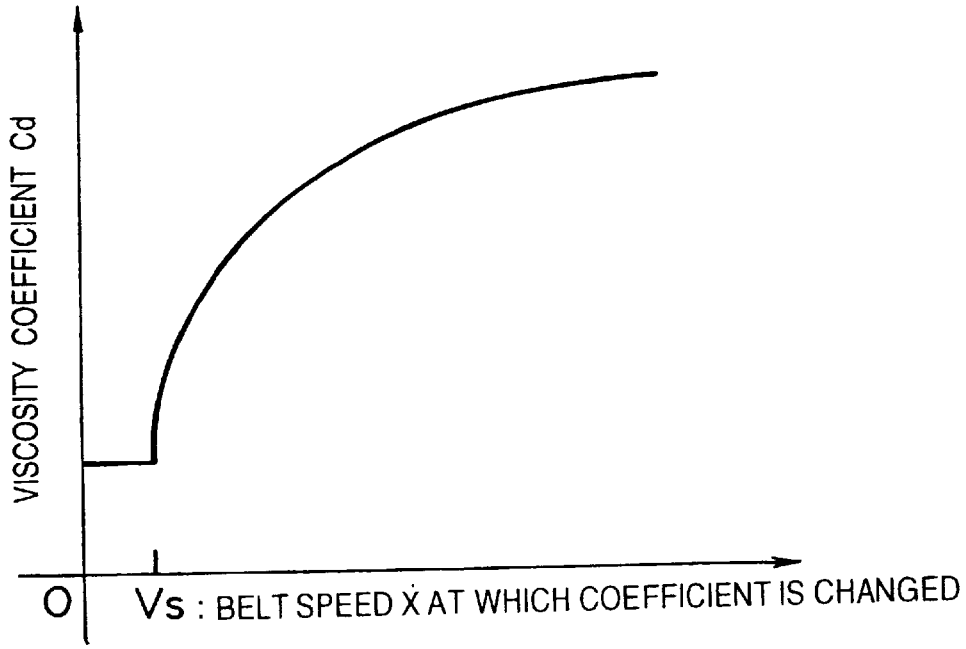
FIG. 11 is a view showing an example of the load characteristic of the walking path surface means according to the present invention.

At this stage, $c_d$ is defined as a function of dx/dt, which is a first order differentiation of x as shown in FIG. 11. When the belt speed is low upon lifting from the floor, $c_d$ is decreased so as to allow easy kicking, but when the belt speed is high upon lifting from the floor, $c_d$ is increased so as to prevent the foot part from being pulled rearward.

In this embodiment, the load is changed at four stages, and the weight is increased at ten stages. Although the stage of the load cannot be changed in a condition other than the stopping condition, the addition of the weight can be made even during exercise. With the use of the weight increasing and decreasing switches 66 (independent from each other between the left and right sides), the weight can be increased and decreased while the condition of the trainee U is observed.

Next explanation will be made of the image display device 56 in the case of using the image reproducing device 57. Such a case that an external input is used will be explained latter. The following two kinds are prepared as images for exercise.

(a) Images for exercise

Images for landscape full of undulation are prepared, which are obtained by picking up images from the view point of the trainee so as to aim at carrying out exercise with high realism. This is suitable in particular for setting the reproducing speed of the images so as to be proportional to a walking speed.

(b) Relaxation Images

Images obtained by editing beautiful scenery such as flowers, birds or fishes in order to exhibit relaxation. It is not necessary to set the reproducing speed of the images so as to be proportional to a walking speed.

By combining the settings of the assist device 3 and the walking path surface device 2, the exercise for recovery of the walking function is carried out. Explanation will be made of the settings and contents of the assist device 3 and the walking path surface device 2.

Assist device: Load Reduction, Waking Path Surface Device: Constant Speed Walking:

These settings are suitable for such a case that the trainee whose physical burden is low so that the trainee custom becomes accustomed, irrespective of a degree of trainee's disorder. Further, it is suitable for a trainee U as a patient having just being surgically operated, who can hardly stand upright, and the trainee can start function recovery exercise just after the surgical operation. Thus it is advantageous in view of such a fact the bed-ridden tendency can hardly occur.

Assist device: Load reduction, Walking path device: Load walking:

Since the looped belt 5 does not move unless the trainee U moves his legs, it is suitable for carrying out exercise of walking motion in which legs are largely and longitudinally swung, for a patient whose joint becomes contracture (being congealed). Conventionally such an exercise has been carried out with the use of a bicycle type ergometer, but has not been suitable for a kind of joint disorder in many cases. However, if it is carried out in such a walking configuration, an applicable range of the patients can be widened.

Assist device: Correction of the posture, Walking path surface device: Constant Speed walking:

It is suitable for training the muscular for supporting the upper part of the body, for a trainee U who can stand upright more or less.

Assist device: Correction of the posture, Walking path surface device: Load walking:

It is a setting which is used by the patient who carries out function recovery exercise. If the load to the looped belt 5 is increased, training for muscular strength can be made.

Next explanation will be made of a method of manipulating the ambulatory exercise machine.

The manipulation of the ambulatory exercise machine according to the present invention is started in the manipulating part 58 which is arranged at the side surface of one of the panels 6. The content of the manipulation includes starting/stopping of the ambulatory exercise machine 1, operational setting for the components, and display of behavior of the trainee U during exercise.

The input device 60 is provided with independent switches with respect to special manipulation so as to cope with the manipulation. In this embodiment, the following independent switches are used:

(1) starting switch 67 for starting exercise;

(2) completing switch 68 for completing exercise;

(3) speed increasing and decreasing switch 65 for increasing and decreasing the desired speed during constant speed walking;

(4) weight increasing and decreasing switch 66 for increasing and decreasing the drive forces of the left and right looped belts 5*a*, 5*b*, independent from each other.

Conditions of the ambulatory exercise machine can be sorted mainly into three kinds, that is:

(1) Stopping: the assist device 3 and the walking path surface device 2 are both stopped. In this condition, setting of an exercise and storing of results of exercise are carried out:

(2) During exercise: the assist device 3 and the walking surface device are both operated:

(3) Positional adjustment: only the assist device 3 is operated.

Figure 12:
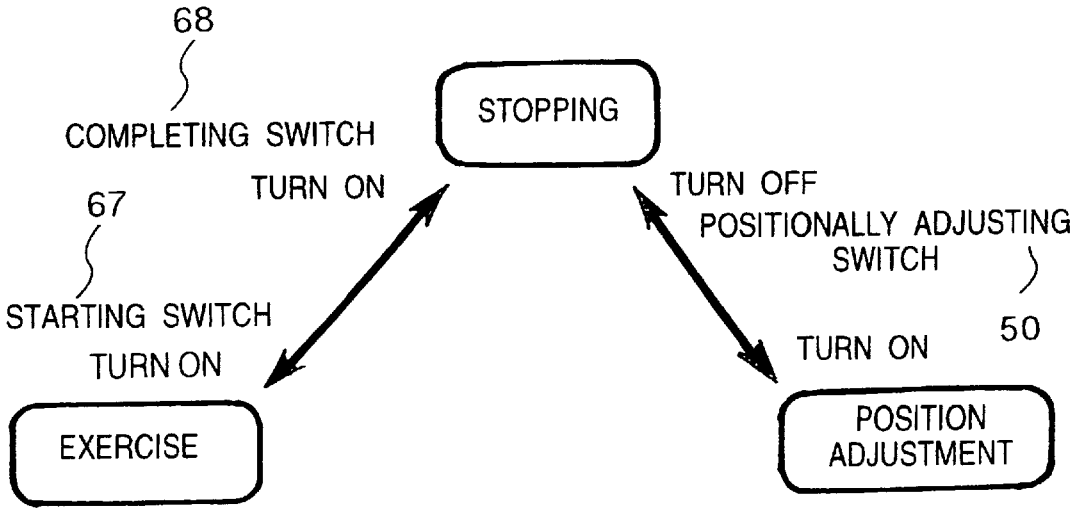
FIG. 12 is a view showing an example of the method of manipulating the ambulatory exercise machine according to the present invention.

In order to manipulate the ambulatory exercise machine 1, it is satisfactory to provide means for shifting the operation mode among the above-mentioned three conditions, as shown in FIG. 12. Thus, a system in which the operating condition of the device is changed by changing over a switch is in general called as an event drive system. This system can facilitate the remanipulation in comparison with sequence operation in which a series of operational steps are successively carried out, and a person who has no special knowledge can optionally operate the machine.

However, in view of safety, the positional adjustment to the assist device 3 by the trainee U during exercise, and the start of exercise during positional adjustment are dangerous. Accordingly, direct shifting into the positional adjustment from exercise and into the start of exercise from positional adjustment is not made. Stopping in the above-mentioned shifting exists always.

As previously described, of the three conditions, (1) is self-explanatory, (2) will be described in setting of the ambulatory exercise machine which will be explained later. The positional adjustment (3) will be at first explained in detail. A position serving as a reference for such a case that the assist device 3 reduces the burden upon the trainee U or corrects the posture of the latter is adjusted to the physical features of the trainee U. In the method of manipulation, since the positional adjustment on the trainee U side is more easy, the assist device 3 is moved by the instructor S by depressing the positionally adjusting switch 50 incorporated in the assist device 3. In order to ensure a sufficient movable range during exercise, a range where the reference position can be set is set, and control is made so as to prevent occurrence of operation outside of the range during positional adjustment.

Shifting from a stopping condition into the positionally adjusting condition, is effected by depressing the positionally adjusting switch 50 attached to the assist device 3, and reverse shifting is effected by releasing the positionally adjusting switch 50. Shifting from the stopping condition into the exercise condition is effected by depressing the start switch on the manipulating part 58, and reverse shifting is effected by depressing the completing switch 68.

Figure 13:
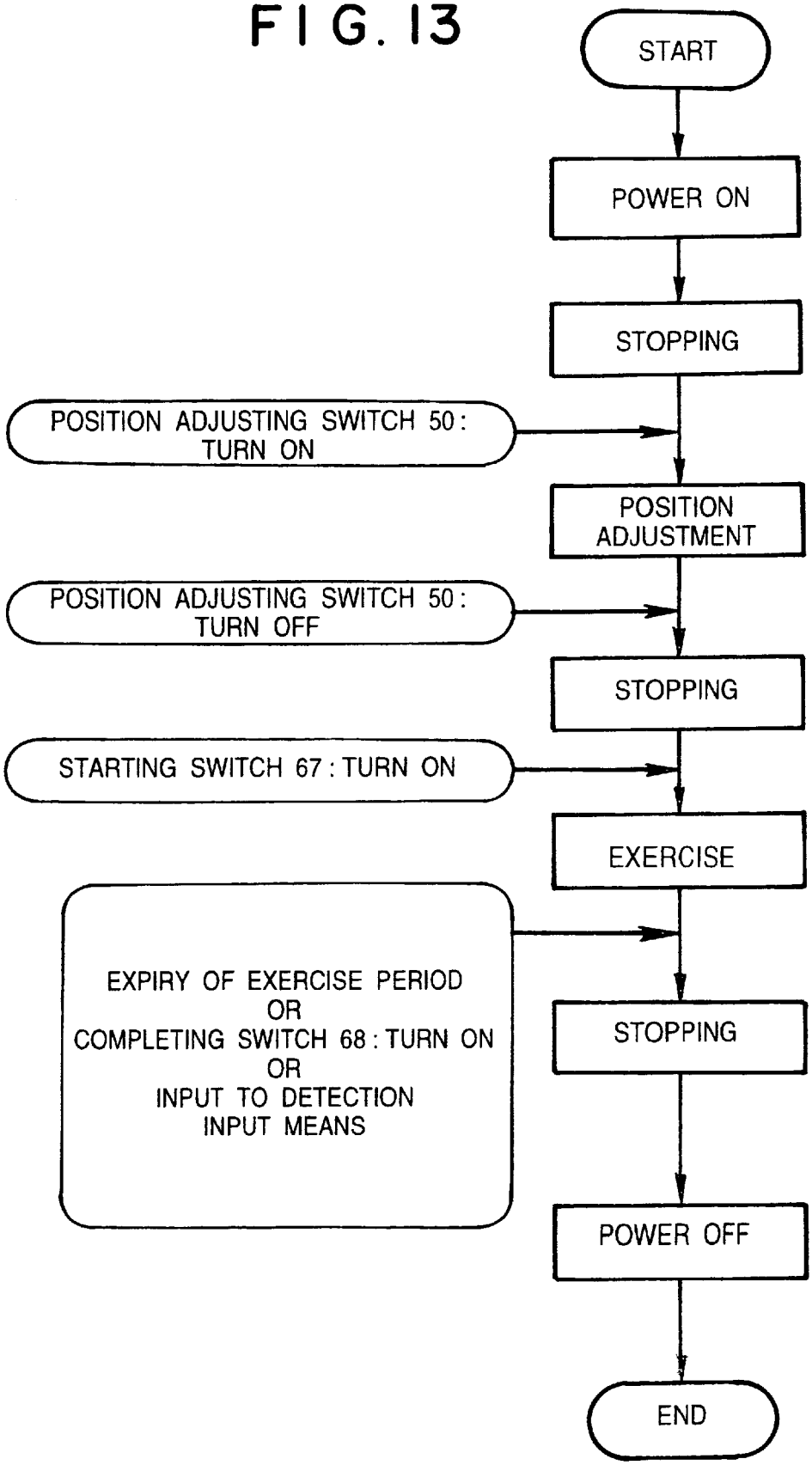
FIG. 13 is a flow-chart for explaining one example of the method of manipulating the ambulatory exercise machine according to the present invention.
Figure 14:
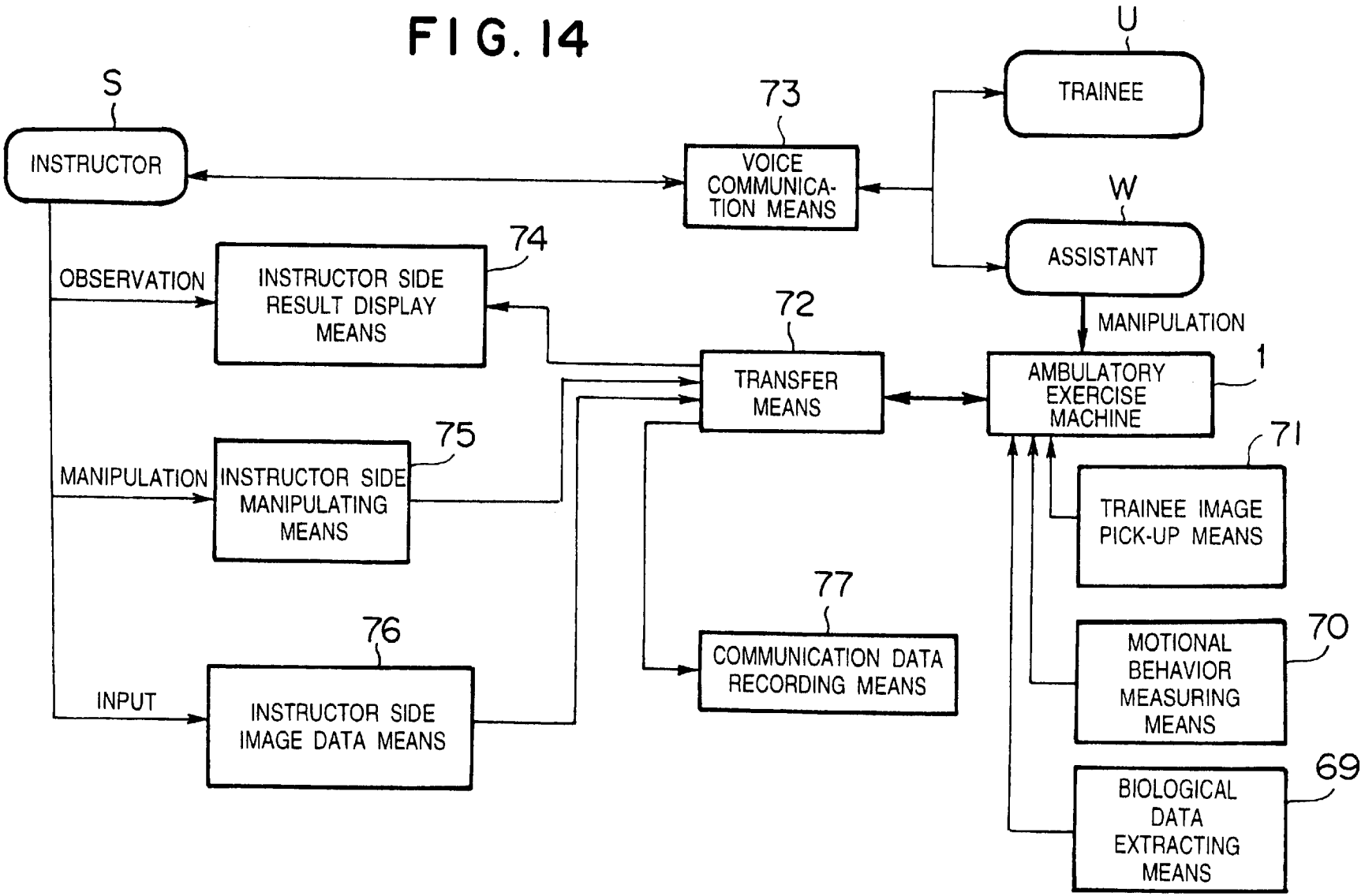
FIG. 14 is a view illustrating a remote-controlled exercise arrangement according to the present invention.

Here, explanation will be made with reference to FIG. 13 which shows a standard flow-chart. After tuning on a power source, the walking path surface device 2 falls into a stopping condition. This is an input waiting condition, and accordingly, operation setting can be made for the ambulatory exercise machine. Then, after allowing the trainee U to stand on the walking path surface device 2, the positionally adjusting switch 50 is turned on so that the positionally adjusting condition is effected. At this stage, the gripping means 23 can be freely displaced in the movable limiting range, and accordingly, the instructor S standing on one side of the walking path surface device 2 introduces the trainee U while gripping the gripping means 23 so as to adjust the assist device 3 to a position where the assist device 3 can hold the trainee U. When the positionally adjusting switch is turned off, the stopping condition is effected, and when the starting switch 67 is turned on, the exercise condition is effected. When a previously set exercise time elapses, it is returned to the stopping condition. Even though it is on the way of the exercise, if the completing switch 68 is turned on, it is returned into the stopping condition. Further, even if any sensor input is given to the detection input device 83 so that the abnormally stopping mode or the emergency stopping mode is effected, it is returned into the stopping mode. It is noted that the power source is turned off only when the stopping condition is effected.

Next, explanation will be made in detail of the memory medium 63. Personal data for the trainee U, exercise parameters for setting the components during exercise and exercise data detected during exercise are managed and stored in this memory medium 63. Basically, one memory medium is prepared for one trainee. This memory medium records therein:

(1) a personal data file stored therein with individual personal data for the trainee such as a name and exercise parameters; and (2) an exercise data file stored therein with results of an exercise.

Further, the personal data relates to the trainee U, including the following items:

Name;

Age;

Sex:

Height:

Weight; and

Case History such as an anamnesis.

In addition to the above-mentioned items, there are stored the following exercise parameters as follows:

In the assist device 3:

Basic motion: selection from load reduction/posture correction;

Load reducing rate: rate between upper force produced upon selection of load reduction and weight of the trainee;

In the walking path surface device 2:

Basis motion: selection from constant speed walking/load walking;

Load upon the looped belt 5 during load walking: four stage;

Desired walking speed during constant speed walking: 0 to 3 km/h;

Weight on the left and right walking path surfaces during load walking: ten stages.

The exercise data file has the following items:

Time and date at which an exercise is carried out;

Personal data during carry-out of the exercise; and

Data measured by the detecting means in the ambulatory exercise machine during carry-out of exercise.

The recognition of the trainee U is made by replacing recording mediums 63*a*. That is, when the recording medium 63*a* is inserted, personal data and exercise parameters recorded on the medium 63*a* are automatically read and set. The exercise parameters which were set at the last time when the memory medium 63*a* was inserted are stored in the memory medium 63. If the memory medium 63*a* is not inserted, the manipulating part 58 uses settings of an imaginary trainee which have been previously stored in the internal memory 64 as settings for the components of the ambulatory exercise machine. The settings for the imaginary trainee include all data relating to the exercise, except a name and a case history.

If a memory medium 63 which has not yet been initialized is inserted, the memory medium is initialized after agreement by the user T, and copying is made for data for the imaginary trainee. If a recording medium which does not belong to the user T is inserted, copying made for data for the imaginary trainee after agreement by the user T.

Standard parameters are prepared, and selection is made among these parameters. As to a place where those parameters are stored, the manipulating part 58 is used. The user can prepare standard parameters by himself, which are then stored in the manipulating part 58. Further, the exercise parameters may be read from the exercise data file prepared past. In order to carry out exercise without using data management by the memory medium 63, the data for the imaginary trainee in the manipulating part 58 may be changed. However, the personal data cannot be rewritten.

With the use of the above-mentioned ambulatory exercise machine 1, explanation will be made of an example in which the exercise is carried out while data is exchanged between the instructor S located at a position where he can not directly see the trainee U, and the trainee S (which is referred as "remote exercise").

Referring to FIG. 4, the following means are added to the ambulatory exercise machine 1 on the trainee side:

(1) biological data extracting means 69 for extracting biological data including a blood pressure and a pulse rate;

(2) motional behavior measuring means 70 for quantitatively measuring motional behaviors such as a posture of the trainee and a walking speed during exercise:

It is noted that the means for detecting a displacement, a walking speed and the like provided in the assist device 3 and the walking path surface device 2 of the ambulatory exercise machine 1 can be used as the above-mentioned means since they measures the motion behaviors of the trainee although the measurement is made indirectly.

(3) trainee image pick-up means 71 for picking up dynamic image or a static image of the trainee U.

In this embodiment, a video camera is provided at a position where the entire body of the trainee U can be measured on his one side. However, various pick-up positions including such a position that a vast shot of the trainee U is picked up in front of the trainee. Accordingly, a plurality of image pick-up means may be installed so that the instructor S may selectively use these means in accordance with a condition of exercise. Further, a plurality of image pick-up means can be used simultaneously if the transfer means 72 can transfer a large capacity of data per unit time.

The following means are present between the ambulatory exercise machine 1 and the instructor S:

(4) transfer means 72 for transferring results measured or picked up by the means on the trainee side to the instructor S side, and transferring various data from the instructor S side to the trainee side. Various transfer means such as a telephone network or a radio net work by way of a satellite network may be used as the transfer means 72;

(5) voice communication means 73 for enabling voice communication between the trainee U (including an assistant) and the instructor S. Specifically, a transmitter incorporating a microphone and a speaker (including headphone and earphone) for transmitting a voice through a wireless measure or wires or a TV telephone network may be used as the voice communication means 73.

The following means are present on the instructor S side:

(6) instructor side result display means 74 for displaying thereon results which are measured and picked up on the ambulatory exercise machine 1 side and transferred to the instructor S side;

(7) instructor side manipulating means 75 for enabling the manipulation of the ambulatory exercise machine 1 from the instructor S side; This means 75 includes the functions substantially equal to those in the manipulating part 58 of the ambulatory exercise machine, and sets the motions of the walking path surface device 2 and the assist device 3 during exercise. Further, it can change over inputs of the image display device, and can change over the trainee image pick-up means 71 if a plurality of the latter are present;

(8) instructor side image data means 76 for extracting image data prepared on the instructor S side, and transmitting the same to the ambulatory exercise machine 1.

As to the image data, for example, a chart in which results of the exercise for the trainee U are arranged with the use of the instructor side result display means 74, and an image picked up from a condition of the instructor S are used. Further, exchange of images picked up from the conditions (for example, expressions) of the instructor S and the trainee U between both is effectively carried out while using the means of enabling the conversation between the instructor S and the trainee U. Thus, the exchange of opinion and conversation or the like relating to the results of exercise can be effectively made between the instructor S and the trainee U while they observes their faces with each other. The typical means is a video camera similar to the trainee image pick-up means 71.

Further, the following means are present at arbitrary positions between the trainee side and the instructor side:

(9) communication data recording means 77 for recording all data exchanged between the trainee side and the instructor side during use of the ambulatory exercise machine 1.

With the use of the above-mentioned auxiliary means, the instructor S can observe a condition of the trainee U, making conversation with the trainee U, and can manipulate even the ambulatory exercise machine 1 even though the instructor S takes a position where he can not directly observe the trainee U.

However, in order to cope with an emergency affair such as erroneous operation of the ambulatory exercise machine, an assistant W for the instructor S is sometime required on the trainee U side. In this case, the input of settings alone is made through the instructor side manipulating means 75, the assistant W may be entrusted with the starting of exercise, the stopping of exercise and measures for coping with an emergency affair. Such a using method can be applied to such a case that no professional such as a doctor or a physical therapist is present on the trainee side, but a manager for the facility incorporating the ambulatory exercise machine 1 is present on the same side.

Meanwhile, on the side of the trainee U, since the image display device 56 can receive an external input in addition to an image source, data transmitted from the instructor S can be seen on the image display device 56 just before the trainee U, and further, the conversation can be made while observing the expression of the instructor S. Accordingly, even though the instructor S is present at a position remote from the trainee U, the trainee can have such a recognition that the exercise can safely be carried out under sufficient observation by the instructor S.

Next, explanation will be made of another embodiment of the control of the walking path surface with reference to FIGS. 1 and 15. It is noted that the control of the walking path surface in this embodiment may be used together with the control of the walking path surface in the aforementioned embodiment so as to constitute the ambulatory exercise machine 1.

Figure 15:
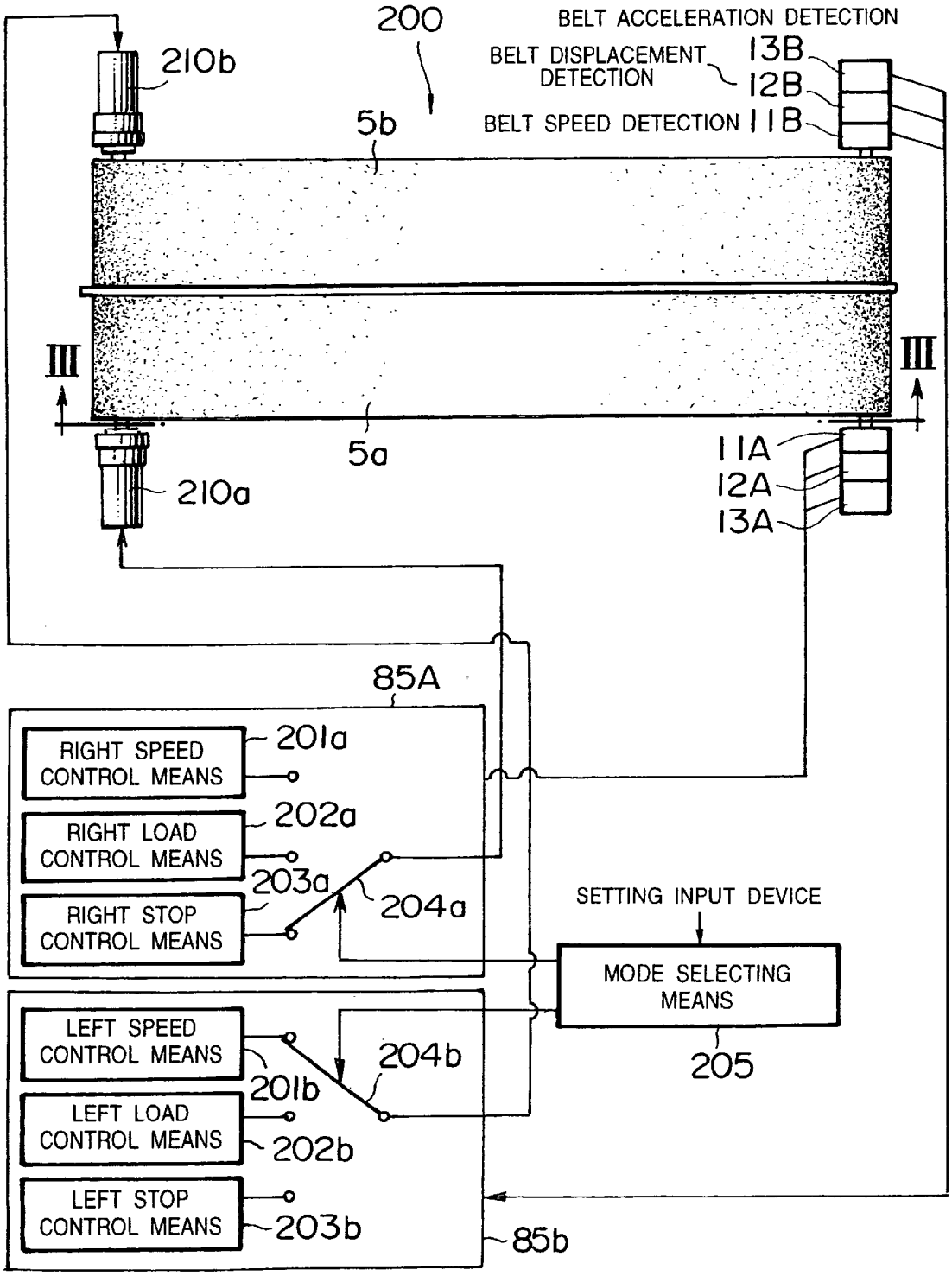
FIG. 15 is a top view illustrating another embodiment of the walking path surface device.

The walking path surface device 2 in this embodiment, is operated by left and right motors 210*a*, 210*b* so as to run the left and right looped belts 5*a*, 5*b*, as shown in FIG. 15. In this arrangement, left and right driven rollers 11*a*, 11*b* which are provided on the sides opposite to the sides where their respective motors 210*a*, 210*b* are provided thereto with belt speed detecting means 211*a*, 211*b* for detecting speeds of the looped belts 5*a*, 5*b*, belt displacement detecting means 212*a*, 212*b* for detecting displacements of the left and right looped belts 5*a*, 5*b*, and acceleration detecting means 213*a*, 213*b* for detecting accelerations of the left and right looped belts 5*a*, 5*b*.

In this embodiment, various operating modes (which will be described later) during ambulatory exercise and set values in these various modes can be inputted for the left and right looped belts 5*a*, 5*b*, independent from each other. For this input, a keyboard 58*b*, the memory medium 63*a*, the read/write device 63*b* and the like shown in FIG. 1 are used.

In this arrangement, the control of the left and right looped belts 5*a*, 5*b* can be carried out in accordance with inputted setting with the use of the torque computing means 85 in the control device 81 for the walking path surface device shown in FIG. 9. Further, control values for controlling the motors 210*a*, 210*b* as the drive means can be computed with the use of outputs from various sensors such as encoders prepared as the speed detecting means 9 for the looped belts.

The computation of the control values can be made by using computation based upon control rules disclosed, for example, Japanese Laid-Open Patent No. 8-141027. In this arrangement, a data base 17 is incorporated in order to store in memory the load characteristic of the walking path surface device or different control rules (arithmetic expressions). As to the load characteristic, a substantial equivalent mass, an equivalent damping coefficient, an equivalent spring constant or the like which are obtained by modeling the mechanical system of the walking path surface device may be used. Further, although the above-mentioned publication discloses a plurality of control rules, a passive ambulatory exercise machine which can be moved at a speed in accordance with forces by which the trainee kicks the looped belts can be materialized by using a desired value of the above-mentioned load characteristic and speeds of the looped belts or external force exerted to the looped belts (tensions of the looped belts).

By the way, the ambulatory exercise machine according to the present invention, incorporates such an exercise mode that either one of the left and right looped belts Sa, 5*b* is substantially stopped while exercise is carried out. The exercise modes including this mode, inherent to the ambulatory exercise mode in this embodiment will be explained.

At first, cases owned by trainees are sorted into the following three classes:

Class 1: the muscular force for moving the leg is extremely weak, and motions other then vertical motion cannot be substantially made;

Class 2: the force for kicking the road surface is extremely weak although the leg can be moved back and forth; and Class 3: the leg can be moved back and force, and further, the road surface can be kicked.

Meanwhile, the following four kinds of the operating modes to be set for the left and right looped belts 5*a*, 5*b* are prepared:

(1) Stopping (fixing) mode:

The looped belts are fixed or held at a constant position so that the looped belts are unmovable. In order to realize this mode, for example, a speed feed-back control loop using an integrated value of the output of the displacement detecting means 212 or the speed detecting means 211 may be provided in the torque computing means 85, or a brake is incorporated in the motor 210 as the drive means.

(2) Speed control mode:

The speed of the looped belt 5 is moved at an inputted desired speed. In order to realize this mode, for example, a speed feed-back control loop using the belt speed detecting means 211*a*, 211*b* is provided in the torque computing means 85.

In this speed control mode, the running speed of the looped belt 5 may be constant, but also may be changed. Further, in the case of changing the speed, the acceleration may be gradually made by detecting landing of the foot of the trainee. Further, a speed pattern may be determined in accordance with a difference between a position where the foot lands and a position where the foot rises up so as to reduce or adjust the burden upon the trainee. In this case, deceleration control in which the looped belt is driven and accelerated from the time of landing, and is stopped when it comes to a position where the foot rises up, may be carried out.

Detection of the position where the foot lands and the position where the foot rises up is made by using the sensors provided to the above-mentioned free rollers.

(3) Load control mode:

A load to the looped belt as viewed from the trainee is controlled so as to become an input load. As to this control mode, for example control disclosed in Japanese Laid-Open Patent No. 8-14102 can be used. Although detailed explanation will be omitted here, active impedance control is used in order to set the load characteristic of the walking path surface device 2 as viewed from the trainee, and further, a force for driving the belt 5 so as to assist the kicking, is exerted so as to realize the passive ambulatory exercise machine for carrying out motion in accordance with a force with which the trainee kicks the walking path means. Further, the load characteristic can be changed optionally in accordance with a leg power of the trainee. This control mode is suitable for increasing or maintaining the muscular strength of a leg in relation to the class 3 in which the trainee can kick the road surface.

In the load control mode, the drive force for assisting the kicking has a degree which can cancel out a resistance force owned by the mechanism of the walking path surface, such as a friction, and accordingly, the looped belt is stationary in a no load condition. Accordingly, it is required for the trainee U to kick the looped belt, irrespective the degree of the force.

Further, if the drive force for assisting the kicking becomes large, it can be applied to the class 2 in which the leg can be moved back and forth, but the force with which the trainee kicks the road surface is extremely small. This system is in particular referred as a drive assist mode. Next the drive assist mode will be detailed.

(4) Drive assist mode

Similar to the load control mode, in this control mode, an active impedance control mode is used, a load characteristic as view from the trainee is determined, and further, a force for driving the looped belt is exerted so as to assist the kicking. The drive force for assisting the kicking is exerted up to such a degree that the looped belt is moved at a constant speed, in a condition in which the trainee has not yet ridden on the looped belt, that is, in a no load condition.

This drive assist mode is suitably used for the class 1 or a class 2 in which the trainee has no kicking force. Further, since the motion is carried out at a speed in accordance with a kicking force, the leg can be moved back and force as in the class 2, but even though the kicking force is extremely small, a speed in accordance with a motion of a leg of the trainee can be set.

With four operating (control) modes, the exercise which can satisfy the condition of the trainee.

Further, many trainees who require ambulatory exercise, in general, have been disordered in his either one of his left and right legs, being caused by apoplexy (single leg paralysis) or bone fracture. Accordingly, it is sometimes preferable for such trainees, to select different operating modes at the same time, respectively for the left and right looped belts.

FIG. 15 shows an arrangement which is provided with a change-over means (selecting means) for operating the left and right looped belts in different operating modes, respectively.

The toque computing means 85 incorporates therein computing means 85*a* for the right looped belt, and computing means 85*b*. These computing means can be prepared by software technique.

The computing means 85*a* for the right looped belt incorporates a right speed control means 201*a*, a right load control means 202*a* and a right stop control means 203*a* which are prepared by means of software. Similarly, the computing means 85*b* for the left looped belt incorporates a left speed control means 201*b*, a left load control means 202*b* and a left stop controlling means 203*b* by means by means of software. The speed control means performs the above-mentioned speed control mode, the load control means carries out the above-mentioned load control mode and drive assist mode, and further, the stop control means carries out the stop control mode.

Data required in the above-mentioned modes, such as the load characteristic of the waling path surface device and the like are stored, for example, in a data base 901 shown in FIG. 9.

Further, as shown in FIG. 15, control means 201*a* to 2032*a* for the right looped belt and the control means 201*b* to 203*b* for are suitably selected by the change-over means 204*a*, 204*b*. In this arrangement, when a desired mode is designated through the keyboard 58*b* or the like, a mode selecting means 205 selects suitable control means from the computing means 85*a* for the right looped belt and the computing means 85*b* for the left looped belt. These change-over means 204*a*, 204*b* may also be prepared by means of software.

In this arrangement, it is convenient if commands or keys are provided so that the mode selecting means 205 selects suitable control means from the computing means 85*a*, 85*b* in response to the operation of the commands or keys.

Next, explanation will be hereinbelow made of an exercise method in which different operating modes are selected respectively for the left and right looped belts. In the following explanation, one of the legs of the trainee having a functional disorder will be referred as "disabled side leg", and the other one of the legs having no functional disorder will be referred as "normal side leg".

(1) The stop control mode is selected for the looped belt corresponding to the affected side leg", and one of the speed control mode, the load control mode and the drive assist mode is selected for the looped belt corresponding to the healthy side leg.

A patient whose one of legs is functionally disordered, to tend to have less opportunity for using his legs since the function of the affected side leg is low a low function. As a result, the healthy side leg would decreases its strength due to lack of exercise. In this method, exercise can be applied only to the healthy side leg.

In such a case that even the healthy side leg becomes weak, the above-mentioned class 1 or 2 can be applied thereto. For the trainee in this class, the speed control mode or the load control mode is used. Specifically, in the case of the class 1, the speed control mode is used. It is believed that the trainee can gradually recover his leg strength, and accordingly, he can well move his healthy side leg back and forth if the desired speed value is increased each time when the exercise is repeated. The drive assist mode is selected in the case of the class 2.

If the function of the healthy side corresponds to the class 3, the load control mode is selected.

2) The stopping mode is selected for the looped belt corresponding to the healthy side leg, and either one of the speed control mode, the load control mode and the drive assist mode is selected for the looped belt corresponding to the affected side leg.

In this method, the exercise can be carried out at a speed or a load in accordance with a function of the affected side leg.

If the affected side leg is excessively weak, the above-mentioned class 1 or 2 can be applied. The speed control mode or the drive assist mode is used for such a trainee. In the case of the class 1, a mode in which the speed is constant is applied, and the desired speed value is increased each time when the exercise is repeated. Thus, it is believed that the trainee can recover his strength, and accordingly, he can well move his affected leg. The assist mode is used in the case of the class 2.

If the function of the affected side leg corresponds to the class 3, the load control mode is used. If the load control mode can be used for the affected side leg, the exercise for both legs can be carried out.

3) The load control mode is selected for the looped belts for both affected and healthy side legs in such a way that the load exerted to the looped belt corresponding to the affected side leg is set to be lower than that corresponding to the healthy side leg. This process can be used for the class 3 in which the legs of a patient can have kicking force although the strengths of the legs are different from each other.

Since the load to the affected side leg is lower than that to the healthy side, the trainee can walk in such a condition that the speed of the affected side leg is equal to that of the healthy side leg. As a result, satisfactory balance can be taken between the left and right side legs, and accordingly, the trainee can walk in a normal posture.

As the affected side leg recovers its strength, the load thereto is increased, approaching the load to the healthy side leg. If a slight difference is appreciated between the loads corresponding to the left and right legs, it can be considered the functions of the left and right legs become equal to each other.

4) The speed control mode is selected for the looped belt corresponding to the healthy side leg, the drive assist mode or the load control mode is selected for the looped belt corresponding to the affected side leg. The function of the healthy side mode can approach that of a normally healthy person. This process can be applied to a trainee whose healthy side leg has a function substantially equal to that of a normally healthy person, but whose affected side leg has such a function that is applied thereto with the class 2 or 3. The trainee carries out the ambulatory exercise having such consciousness such that the speed of the looped belt corresponding to the affected side let is made to be equal to that corresponding to the healthy side leg.

5) The load control mode is selected for the looped belt corresponding to the healthy side leg, and the drive assist mode is selected corresponding to the affected side leg. The function of the affected side leg can approach that of the healthy side leg. This process can be applied to a trainee whose healthy side leg has a function substantially equal to that of a normally healthy person, but whose affected side leg has such a function that is applied thereto with the class 2 or 3. The trainee carries out the ambulatory exercise having such consciousness such that the speed of the looped belt corresponding to the affected side let is made to be equal to that corresponding to the healthy side leg.

6) The speed control mode is selected for both looped belts in such a way that the speed of the looped belt corresponding to the affected side leg is lower than that corresponding to the healthy side leg. This process can be applied to a trainee whose healthy side leg has a function substantially equal to that belonging to the class, and whose affected side leg substantially equal to that belonging to the class 3.

7) The drive assist mode is selected for the looped belt corresponding to the affected side leg, and the speed control mode is selected to that corresponding to the healthy side leg so as to carry out ambulatory exercise. If the difference in speed between the affected side leg and the healthy side leg becomes smaller, it is believed that the functions of the left and right legs of the trainee becomes substantially equal to each other. This process can be applied to a trainee whose both healthy and affected side legs have a function belonging to the class 2, but whose affected side leg is lower in its function than the healthy side leg.

In addiction to the modes as mentioned above, it is preferable to incorporate such a mode that both left and right looped belts 5*a*, 5*b* are stopped in order to various setting can be easily made in such a condition that riding and alighting onto and from the looped belt is made or in such a condition that standing on the looped belts is made.

Further, it is preferable to additionally incorporate such a mode that the exercise can be carried out while both left and right looped belts are stopped, either one of them is stopped from running, or the exercise can be carried out while the running speed is manually adjusted. For example, the grip part 40 of the handle 30 shown in FIG. 1 is used as the manipulating part. Specifically, the grip part 40 is provided thereto with a detector for detecting a rotating angle of the grip part 40 so as to change the running speed of the looped belts in accordance with a detected rotating angle of the grip part 40 rotated by the trainee. That is, the speed control of the looped belts is effected by the torque computing means 85 in order to obtain a desired speed corresponding to the rotating angle. Although this can be made through precise speed feedback control, this can be also made by the trainee himself who finely adjusts the speed to a value which can satisfy his pace. In this arrangement, there is incorporated a selecting means which designates such a mode that the speed adjustment is made to both or either one of the left and right looped belts. Further, the looped loop which has not been selected may be made to run in either one of the above-mentioned operating mode. Further, it is preferable to incorporate at least either one of a rear belt 43 and a waist belt 45 for supporting the trainee to the support arms in order to prevent the trainee from erroneously rotating the grip part 40 by a large degree when he disorders his posture. Further, means for changing (adjusting) the sensitivity of the grip part 40 with respect to a change in the running speed of the looped belt may be provided. With the above-mentioned measures, it is possible to prevent the trainee from feeling inconvenience in the gripping manipulation even though the speed range to be used is differ from trainee to trainee. Such a means is easily composed of the torque computing means 84, a data base 9001 or the like.

Figure 16:
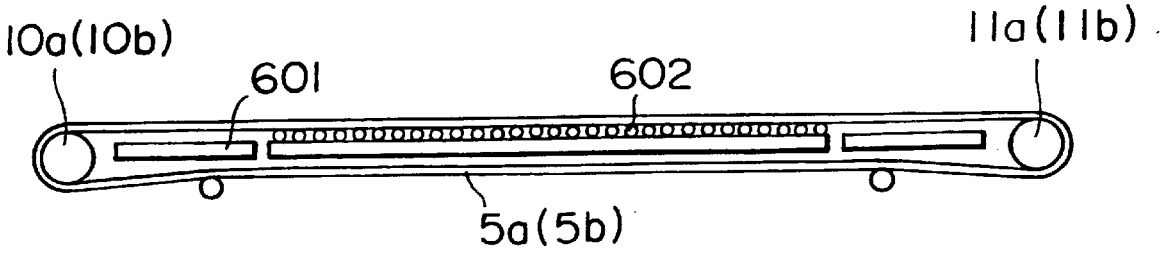
FIG. 16 is a sectional side view illustrating another embodiment of the walking path surface device.

In another embodiment of the walking path surface device 2 will be explained with reference to FIG. 16.

Instead of the free roller 21 used in FIG. 3, a slip sheet 602 is laid on the table 601, a table 601 serves as a member for supporting the looped belts 5*a*, 5*b*, and a slip sheet reduce the friction resistance which is effected when the looped belts 5*a*, 5*b* run. The slip sheet 602 is formed of fluorinated resin coated over the surface of a steel table.

As mentioned above, in the ambulatory exercise machine incorporating the walking path means for exhibiting a walking path for the trainee, the walking path means serves as walking path surfaces which operate, independent from each other, respectively, for the left and right legs of the trainee, that is, the left and right walking path means each selects an operating mode from the following modes in order to carry out ambulatory exercise which is not available when walking is made on the normal road surface:

(1) a mode in which one or more of the displacement, the speed and acceleration of the walking path means is measured in order to drive the walking path means in accordance with control rules using the measured value, so as to control the load characteristic of the walking path means as viewed from the trainee (load control system);

(2) A mode which a drive force for assisting kicking up to such a degree that the walking path means can move at a constant speed even though the trainee does not ride on the walking path surface, that is, no load condition (drive assist mode);

(3) A mode in which the walking path means becomes equal to a set value (speed control mode000), and (4) A system in which the walking path means is immovable (walking path fixing mode).

In particular, this is effective for the trainee whose either the strength of either one of the legs becomes weaker than that of the other one of legs due to cerebral apoplexy.

What is claimed is:

1. An ambulatory exercise machine comprising walking path surface means and assist means provided in front of the walking path surface means, for assisting a trainee standing on the walking path surface means, wherein the walking path surface means includes a walking path surface for the trainee and drive means for driving the walking path surface, wherein the assist means includes support arms supporting a waist part of the trainee in front and at sides of the trainee, the assist means enabling a space between left and right arms to be adjusted and further including drive means for driving the support arms, and wherein the support arms enable attachment of a belt for holding the trainee so that the trainee is movable within a desired range.

2. An ambulatory exercise machine comprising walking path surface means and assist means provided in front of the walking path surface means, for assisting a trainee standing on the walking path surface means, wherein the walking path surface means includes a walking path surface for the trainee and drive means for driving the walking path surface, wherein the assist means includes support arms supporting a waist part of the trainee in front and at sides of the trainee and enabling the space between left and right arms to be adjusted, the assist means further including drive means for driving the support arms, the support arms having a longitudinal depth of less than 155 mm and enabling attachment of a belt to the rear end part thereof.

3. An ambulatory exercise machine comprising walking path surface means and assist means provided in front of the walking path surface means, for assisting a trainee standing on the walking path surface means, wherein the walking path surface means includes a walking path surface for the trainee, and drive means for driving the walking path surface, and wherein the assist means includes support arms supporting a waist part of the trainee in front and at sides of the trainee and enabling a space between left and right arms to be adjusted, the circuit means further including drive means for driving the support arms, the support arms including left and right arms having a thickness of less than 40 mm, the support arm enabling attachment of a belt for holding the trainee so that the trainee is movable in a desired range.

4. An ambulatory exercise machine comprising walking path surface means and assist means provided in front of the walking path surface means, for assisting a trainee standing on the walking path surface means, wherein the walking path surface means includes a walking path surface for the trainee and drive means for driving the walking path surface, and wherein the assist means includes support arms supporting a waist part of the trainee in front and rear of the trainee and enabling the space between left and right arms to be adjusted, the circuit means further including drive means for driving the support arms, the support arms being drivable in a vertical range of 600 to 1,200 mm measured from the walking path surface and in a longitudinal range of ±110 mm, the support arms enabling attachment of a belt for holding the trainee so that the trainee is movable in a desired range.

5. An ambulatory exercise machine comprising walking path surface means and assist means provided in front of the walking path surface means, for assisting a trainee standing on the walking path surface means, wherein the walking path surface means includes a walking path surface for the trainee and drive means for driving the walking path surface, and wherein the assist means includes support arms supporting a waist part of the trainee in front and at sides of the trainee and enabling a space between left and right arms to be adjusted, the support arms incorporating a position adjusting switch, a drive device of the support arms being in a position adjusting mode when the position adjusting switch is turned on, and the turn-on of the position adjusting switch not being effective during ambulatory exercise, the support arms enabling attachment of a belt for holding the trainee so that the trainee is movable in a desired range.

6. An ambulatory exercise machine comprising walking path surface means, assist means provided in front of the walking path surface means, for assisting a trainee standing on the walking path surface means, and synthetic control means for controlling the walking path surface means and the assist means, wherein the walking path surface means includes a walking path surface for the trainee and drive means for driving the walking path surface, wherein the assist means includes support arms supporting a waist part of the trainee in front and at sides of the trainee and enabling a space between left and right arms to be adjusted, the assist means further including drive means for driving the support arms, and wherein the synthetic control means is connected to data processing means, the synthetic control means enabling receipt of data relating to exercise for the trainee from the data processing means in order to control the drive means for the support arms and the walking path surface, the support arms enabling receipt of a belt for holding the trainee so that the trainee is movable in a desired range.

7. An ambulatory exercise machine comprising walking path surface means and assist means provided in front of the walking path surface means, for assisting a trainee standing on the walking path surface means, wherein the walking path surface means includes a walking path surface for the trainee and drive means for driving the walking path surface, wherein the assist means includes support arms supporting a waist part of the trainee in front and at sides of the trainee and enabling a space between left and right arms to be adjusted, the support arms enabling attachment of a belt for holding the trainee so that the trainee is movable in a desired range, the walking path surface means and the assist means being separately fixed together.

8. An ambulatory exercise machine comprising walking path surface means and assist means provided in front of the walking path surface means, for assisting a trainee standing on the walking path surface means, wherein the walking path surface means includes a looped belt serving as a walking path surface for the trainee and drive means for driving the looped belt, and wherein the assist means includes support arms supporting a waist part of the trainee in front and at sides of the trainee and enabling a space between left and right arms to be adjusted, the looped belt being driven in one of a mode in which the looped belt is driven at a constant speed and a mode in which the looped belt is driven in accordance with a walking speed of the trainee, the constant speed being limited to 3 km/h at the maximum.

9. An ambulatory exercise machine comprising walking path surface means and assist means provided in front of the walking path surface means, for assisting a trainee standing on the walking path surface means, wherein the assist means includes support arms supporting a waist part of the trainee in front and at sides of the trainee and enabling the space between left and right arms to be adjusted, the assist means further including drive means for driving the support arms, and wherein the walking path surface means includes a looped belt serving as a walking path surface for the trainee, drive means for driving the looped belt, and detecting means for detecting the trainee approaching a front end part or rear end part of the looped belt, the drive means for the looped belt incorporating a first stop mode for stopping the looped belt or a second stop mode for stopping the looped belt for a time which is longer than that in the first stop mode, the looped belt being stopped in the second mode when the detecting means detects the trainee.

10. An ambulatory exercise machine comprising walking path surface means and assist means provided in front of the walking path surface means, for assisting a trainee standing on the walking path surface means, wherein the assist means includes support arms supporting a waist part of the trainee in front and at sides of the trainee and enabling a space between left and right arms to be adjusted, the assist means further including drive means for driving the support arms and detecting means for detecting the trainee, and wherein the walking path surface means includes a looped belt serving as a walking path surface for the trainee and drive means for driving the looped belt, the drive means for the looped belt incorporating a first stop mode for stopping the looped belt or a second stop mode for stopping the looped belt for a time which is longer than that in the first stop mode, the looped belt being stopped in the second mode when the detecting means does not detect the trainee.

11. An ambulatory exercise machine comprising walking path surface means having left and right walking surfaces, and control means for controlling running of the left and right walking path surfaces, independent from each other, wherein the control means incorporates means for continuously controlling one of the left and right walking path surfaces at one constant position.

12. An ambulatory exercise machine comprising walking path surface means having left and right walking surfaces, and control means for controlling running of the left and right walking path surfaces, independent from each other, wherein the control means incorporates means for fixing one of the left and right walking path surfaces, respectively, independent from each other.

13. An ambulatory exercise machine comprising walking path surface means having left and right walking surfaces, and control means for controlling running of the walking path surfaces, independent from each other, wherein the control means incorporates means for holding one of the left and right walking path surfaces while controlling only the other one of the left and right walking path surfaces so as to run.

14. An ambulatory exercise machine comprising walking path surface means having left and right walking surfaces, and control means for controlling running of the left and right walking path surfaces, independent from each other, wherein the control means incorporates a first control means detecting a condition of the left and right walking path surfaces, for controlling the left and right walking path surfaces, independent from each other, a second control means for fixing one of the left and right walking path surfaces and for controlling the other one of the left and right walking path surfaces, and means for selecting one of the first and second control means.

15. An ambulatory exercise machine comprising walking path surface means having left and right walking surfaces, and control means for controlling running of the left and right walking path surfaces, independent from each other, wherein the control means incorporates a plurality of control modes, and means for selecting one of the plurality of the control modes, for the left and right walking surfaces, independent from each other.

16. An ambulatory exercise system including an ambulatory exercise machine comprising walking path surface means and assist means provided in front of the walking path surface means, for assisting a trainee standing on the walking path surface means, the ambulatory exercise system comprising:

(1) means for extracting biological data from a trainee during exercise, (2) first image pick-up means for picking up an image from the trainee, (3) first display means for representing data to the trainee, (4) second image pick-up means located, distant from the ambulatory exercise machine, (5) second display means located, distant from the ambulatory exercise machine, (6) means for transmitting the biological data to a person at the second display means side, (7) means for transmitting data from the second image pick-up means to the first display means, and transmitting data from the first image pick-up means to the second display means, (8) means for intercommunicating between the trainee and the person at the second display means, (9) instructor side manipulating means for allowing an instructor to manipulate the ambulatory exercise machine, and

(10) interrupting means for preferentially displaying data from the first image pick-up means, on the second display means.

17. An ambulatory exercise machine including walking path surface means;

said walking path surface means comprising a looped belt defining a walking path surface for a trainee, a drive means for driving said looped belt, and control means for controlling driving of said looped belt;

wherein said control means controls driving of said looped belt so that said looped belt is driven in a mode in which said looped belt is driven at a constant speed which is limited to 3 km/hour at maximum, or in a mode in which said looped belt is driven at a speed in accordance with a walking speed of said trainee.

18. An ambulatory exercise machine including walking path surface means;

said walking path surface means comprising a looped belt having a leading end part and a training end part and defining a walking path surface for a trainee, a drive means for driving said looped belt, means for detecting a trainee who approaches said leading end part or said trailing end part, and control means for controlling driving of said drive means;

wherein said control means controls said drive means so as to effect a first mode in which said looped belt is stopped, a second stop mode in which said looped belt is stopped for a time which is longer than that by which said looped belt is stopped in the first stop mode, and when said detecting means detects the trainee, said looped belt is stopped in said second mode.

19. An ambulatory exercise machine including walking path surface means, and assist means for assisting a trainee standing on said walking path surface means, and provided in front of the trainee;

said assist means comprising support arms for supporting a waist of said trainee in front of and at left and right sides of the trainee, including left and right arms which can be adjusted so as to change a space therebetween, means for driving said support arms, and means for detecting the trainee;

said walking path surface means comprising a looped belt defining a walking path surface for the trainee, and a drive means for driving said looped belt, means for detecting a trainee who approaches said leading end part or said trailing end part, and control means for controlling driving of said drive means;

wherein said control means controls said drive means so as to effect a first mode in which said looped belt is stopped, a second stop mode in which said looped belt is stopped for a time which is longer than that by which said looped belt is stopped in the first stop mode, and when said detecting means detects the trainee, said looped belt is stopped in said second mode.

* * * * *